US012017818B1

(12) United States Patent
Adame et al.

(10) Patent No.: US 12,017,818 B1
(45) Date of Patent: Jun. 25, 2024

(54) SEPARATE FOOD CUPS JOINED BY SEAL SHEET HINGE

(71) Applicant: DAISY BRAND, LLC, Dallas, TX (US)

(72) Inventors: Ryan Adame, Queen Creek, AZ (US); Matthew Nichols, McKinney, TX (US); Vincent Taylor, Dallas, TX (US); Christine Horan, Northborough, MA (US); Gregg Flender, Bedford, MA (US); Julia Sharpe, Cambridge, MA (US)

(73) Assignee: DAISY BRAND, LLC, Dallas, TX (US)

( * ) Notice: Subject to any disclaimer, the term of this patent is extended or adjusted under 35 U.S.C. 154(b) by 631 days.

(21) Appl. No.: 16/737,422

(22) Filed: Jan. 8, 2020

Related U.S. Application Data

(60) Provisional application No. 62/790,398, filed on Jan. 9, 2019.

(51) Int. Cl.
*B65D 21/02* (2006.01)
*B65D 1/30* (2006.01)
*B65D 77/20* (2006.01)

(52) U.S. Cl.
CPC ..... *B65D 21/0206* (2013.01); *B65D 1/30* (2013.01); *B65D 77/204* (2013.01); *B65D 2543/00305* (2013.01); *B65D 2577/2066* (2013.01)

(58) Field of Classification Search
CPC ..... B65D 21/0206; B65D 1/42; B65D 1/40; B65D 1/44
USPC ..... 220/234
See application file for complete search history.

(56) References Cited

U.S. PATENT DOCUMENTS

| | | | | | |
|---|---|---|---|---|---|
| 3,202,272 | A | | 8/1965 | Hertzog | |
| 3,933,296 | A | | 1/1976 | Ruskin et al. | |
| 3,983,999 | A | * | 10/1976 | Morton | B65D 21/0206 206/820 |
| 4,226,358 | A | | 10/1980 | Ottow | |
| 4,241,863 | A | | 12/1980 | Faller | |
| 4,493,574 | A | | 1/1985 | Redmond et al. | |
| 4,611,715 | A | | 9/1986 | Redmond | |
| 4,903,842 | A | | 2/1990 | Tokuda et al. | |
| 5,158,209 | A | | 10/1992 | Reil et al. | |
| 5,277,920 | A | * | 1/1994 | Weaver, Jr. | B65D 77/2028 206/469 |
| 5,853,105 | A | | 12/1998 | Roman et al. | |
| 5,890,596 | A | * | 4/1999 | Albisetti | B65D 81/3294 206/581 |
| 5,947,278 | A | | 9/1999 | Sawhney et al. | |

(Continued)

*Primary Examiner* — Anthony D Stashick
*Assistant Examiner* — Raven Collins
(74) *Attorney, Agent, or Firm* — Foley & Lardner LLP

(57) ABSTRACT

A food containment assembly includes a first cup with a first sealing flange and a second cup with a second sealing flange. The second cup is separate from and disposed adjacent to the first cup. A seal sheet is adhered to the first sealing flange and the second sealing flange, and the seal sheet forms a hinge to allow rotation of the second cup with respect to the first cup. The seal sheet includes a first slit disposed proximate the hinge and a second slit proximate the hinge, wherein tearing the seal sheet along the first slit allows access to contents of the first cup and tearing the seal sheet along the second slit allows access to contents of the second cup and the hinge remains intact.

19 Claims, 24 Drawing Sheets

(56) References Cited

U.S. PATENT DOCUMENTS

| | | | |
|---|---|---|---|
| 6,305,546 | B1 | 10/2001 | Saunders et al. |
| 6,354,456 | B2 | 3/2002 | Rapson |
| 6,412,637 | B1 | 7/2002 | Saunders et al. |
| 6,412,653 | B1 | 7/2002 | Waterhouse |
| 6,523,686 | B1 | 2/2003 | Bae |
| D492,196 | S | 6/2004 | Hyhlik et al. |
| 7,140,532 | B2 | 11/2006 | Holt et al. |
| 7,549,551 | B2 | 6/2009 | Tyberghein |
| 7,552,835 | B2 | 6/2009 | Kiel et al. |
| 7,691,301 | B2 | 4/2010 | Tyberghein |
| 7,845,147 | B2 | 12/2010 | Henderson et al. |
| D645,764 | S | 9/2011 | Mathis et al. |
| 8,360,262 | B2 | 1/2013 | Vovan |
| 8,689,972 | B2 | 4/2014 | Sanchez et al. |
| 2003/0026876 | A1 | 2/2003 | Albuja et al. |
| 2003/0141218 | A1 | 7/2003 | Stephens et al. |
| 2005/0011898 | A1* | 1/2005 | Van Handel ..... B65D 1/265 220/507 |
| 2006/0180483 | A1* | 8/2006 | Sekendur ..... B65D 51/246 206/216 |
| 2007/0095719 | A1 | 5/2007 | Colavito et al. |
| 2009/0032413 | A1 | 2/2009 | Huber et al. |
| 2009/0039079 | A1 | 2/2009 | Lipinski et al. |
| 2010/0183775 | A1 | 7/2010 | Cudnohoske |
| 2011/0081459 | A1* | 4/2011 | Bourguignon ..... B65D 1/30 220/500 |
| 2011/0117251 | A1 | 5/2011 | Waddup et al. |
| 2016/0130053 | A1 | 5/2016 | Ward |
| 2017/0252507 | A1 | 9/2017 | Schiendzielorz |
| 2018/0346221 | A1* | 12/2018 | Watts ..... B65D 17/501 |

* cited by examiner

SEPARATE FOOD CUPS JOINED BY SEAL SHEET HINGE

PRIORITY CLAIM

This application claims priority to U.S. Provisional Application for Patent Ser. No. 62/790,398, filed on Jan. 9, 2019, and entitled "Separate Food Cups Joined by Foil Hinge," the disclosure of which is incorporated herein by reference.

TECHNICAL FIELD

The present disclosure relates generally to disposable packaging for food products, and more particularly to a food package that includes two separate cups joined by a hinge formed by a seal sheet.

BACKGROUND

Food is packaged in a variety of disposable packages designed, at least in part, based on the consumer experience desired to be provided to the consumer. Other considerations for food packaging includes dispensing the food into the package, sealing the package, transportation and handling the package prior to it reaching the consumer, stacking the packaging either empty for capture and movement by filling and sealing equipment or filled with food on a retailer's shelf. In certain instances, a food provider may want to provide separately packaged food items that are sold together with the purpose of the consumer combining the separate items immediately at the time of consumption. As one example, consumers often enjoy fruit or granola with cottage cheese. The consumer is more likely to have confidence in the freshness of the fruit, if it is not premixed into the cottage cheese. Accordingly, it is desirable to provide a package that separately contains cottage cheese and fruit and allows multiple methods of easy combination by the consumer when consuming the combined product.

SUMMARY

A food containment assembly includes a first cup with a first sealing flange and a second cup with a second sealing flange. The second cup is separate from and disposed adjacent to the first cup. A seal sheet seal is adhered to the first sealing flange and the second sealing flange, and the seal sheet forms a hinge to allow rotation of the second cup with respect to the first cup. The seal sheet includes a first slit disposed proximate the hinge and a second slit proximate the hinge, wherein tearing the seal sheet along the first slit allows access to contents of the first cup and tearing the seal sheet along the second slit allows access to contents of the second cup and the hinge remains intact.

According to certain embodiments, a hinge tear notch focuses forces applied to tear the seal sheet at a location of abutment of the first sealing flange with the second sealing flange. Thus, a user may use the food containment system by breaking the seal sheet hinge or the user may consume the food products with the seal sheet hinge intact. According to the teachings of the present disclosure, a consumer may add all the fruit immediately or may spoon a little fruit with each spoonful of cottage cheese because the secondary container may be maintained combined with the primary container, or the secondary container may be easily removed from the primary container.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE DRAWINGS

Figure 1A:
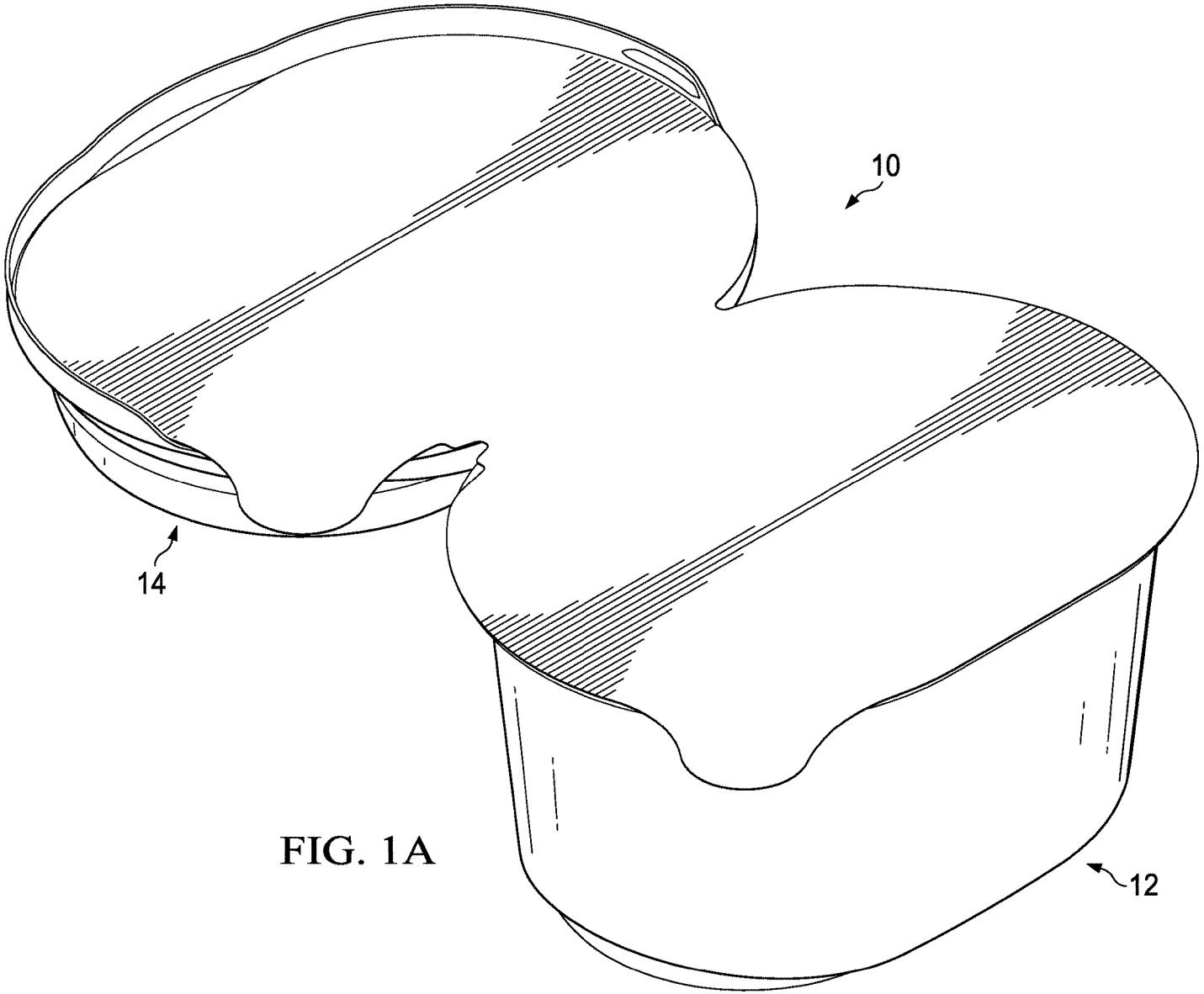
FIG. 1A is a perspective view of a food containment assembly according to the teachings of the present disclosure.
Figure 1B:
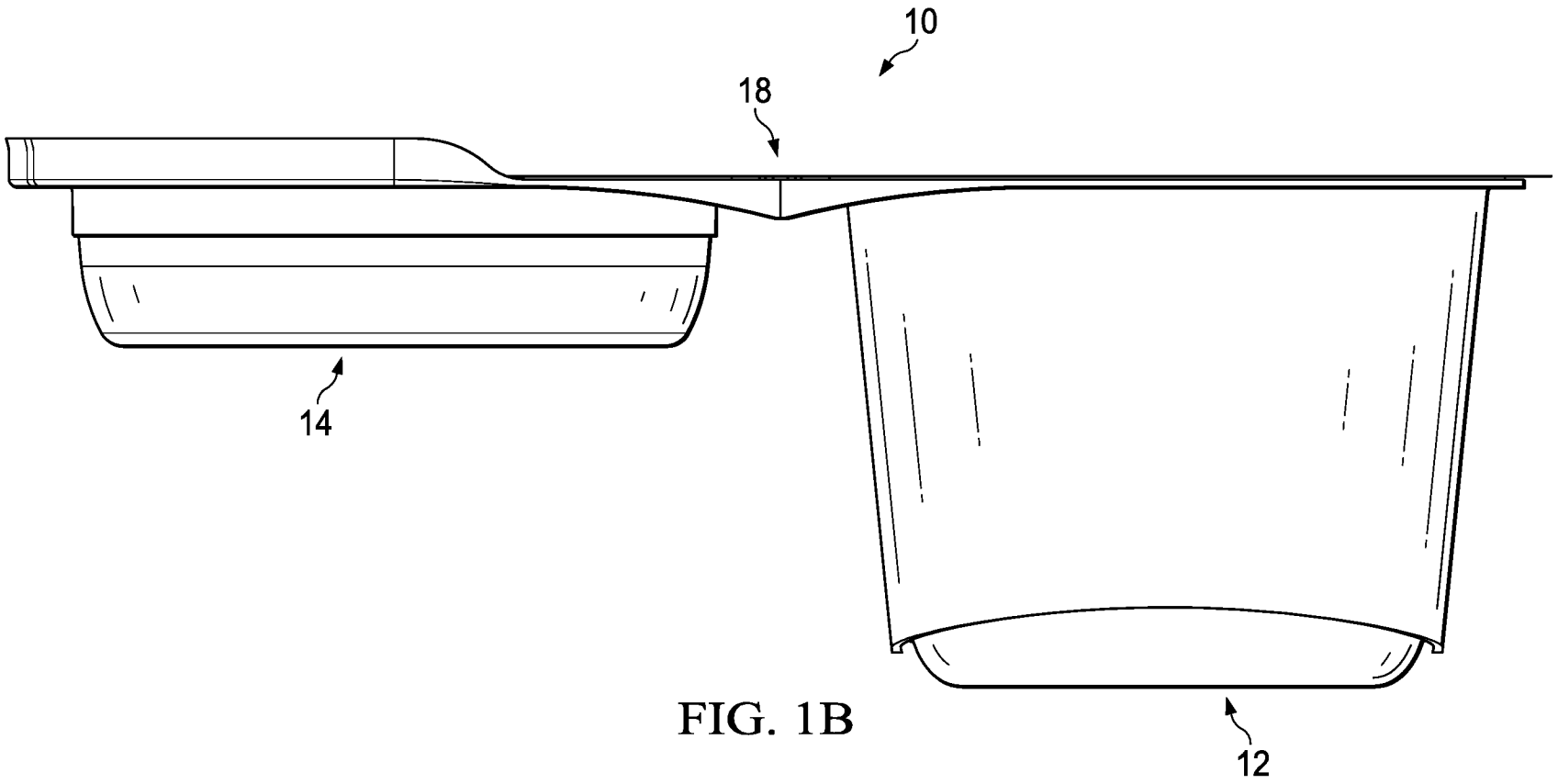
FIG. 1B is a front elevation view of the food containment assembly shown in FIG. 1A, the rear elevation view being a mirror image thereof.
Figure 1C:
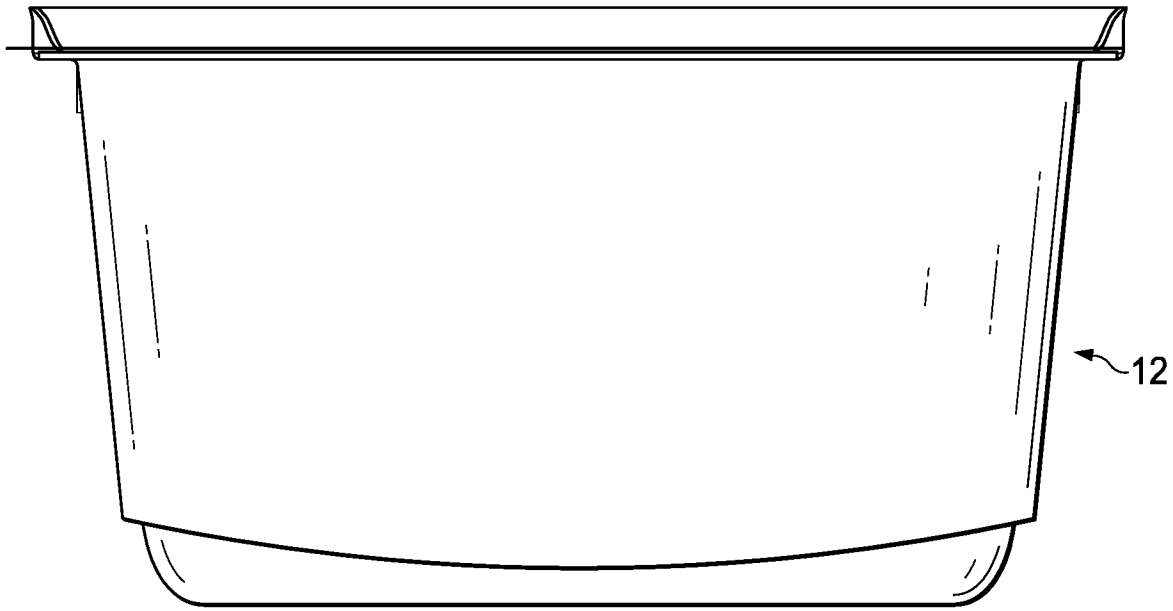
FIG. 1C is a right side view of the food containment assembly shown in FIG. 1A.
Figure 1D:
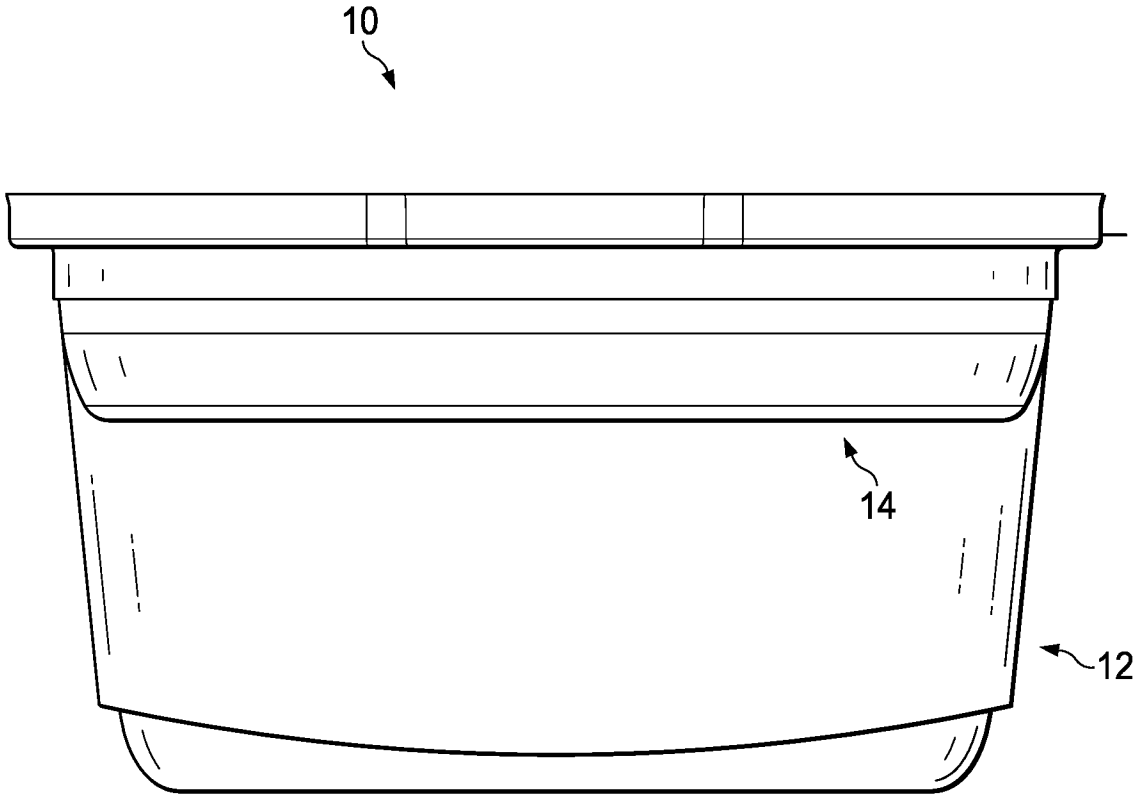
FIG. 1D is a left side view of the food containment assembly shown in FIG. 1A.
Figure 1E:
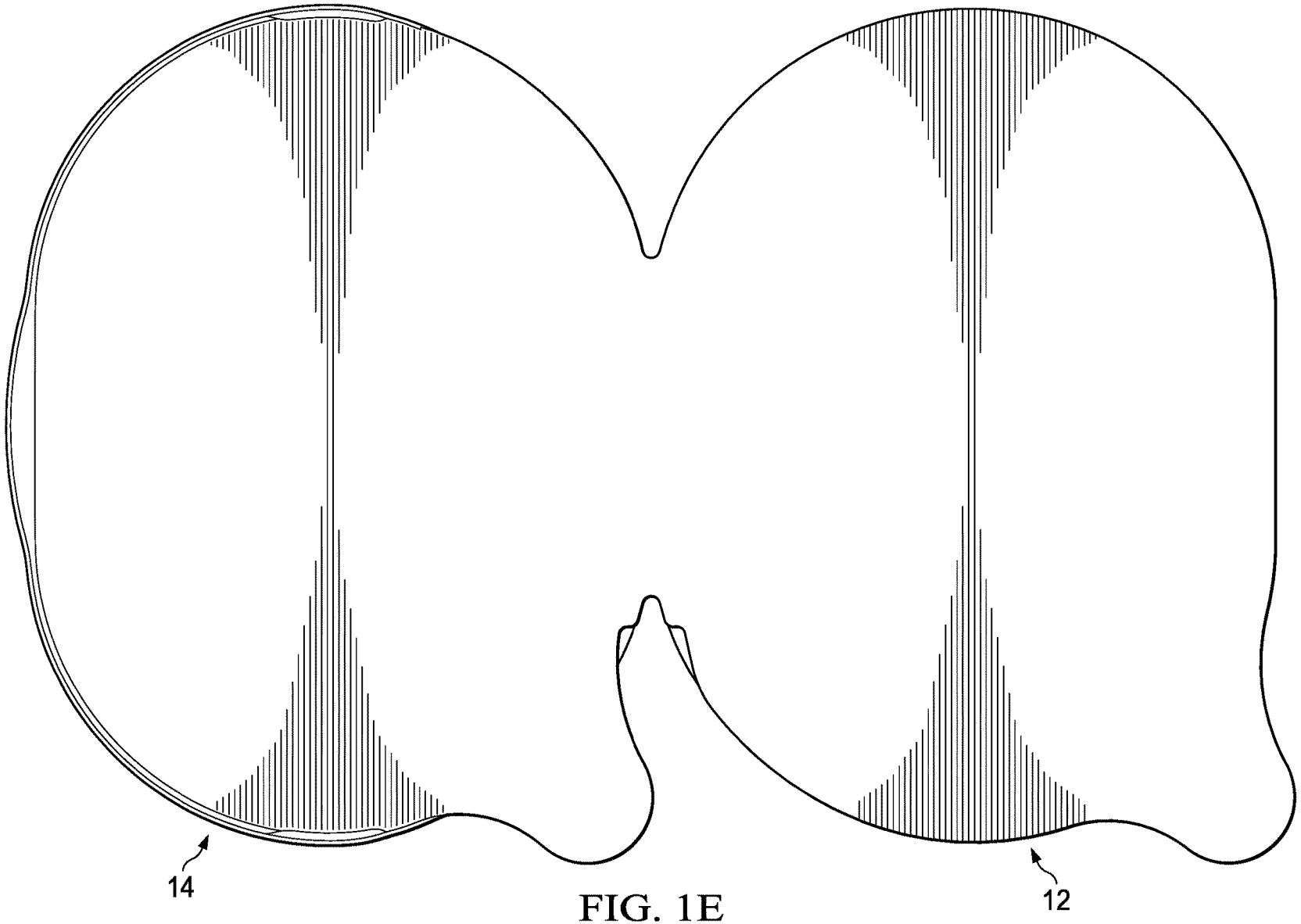
FIG. 1E is a top plan view of the food containment assembly shown in FIG. 1A.
Figure 1F:
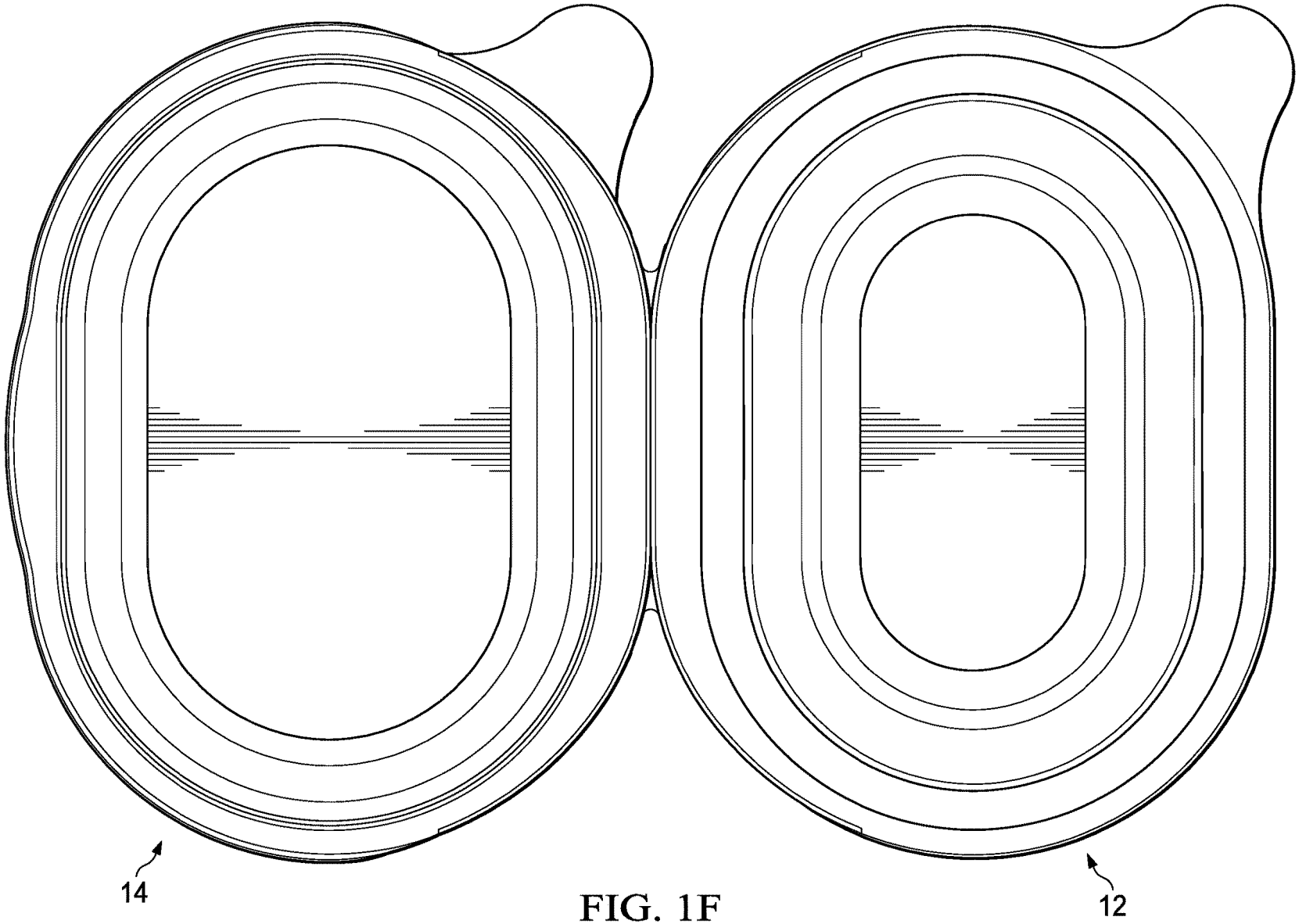
FIG. 1F is a bottom plan view of the food containment assembly shown in FIG. 1A.
Figure 1G:
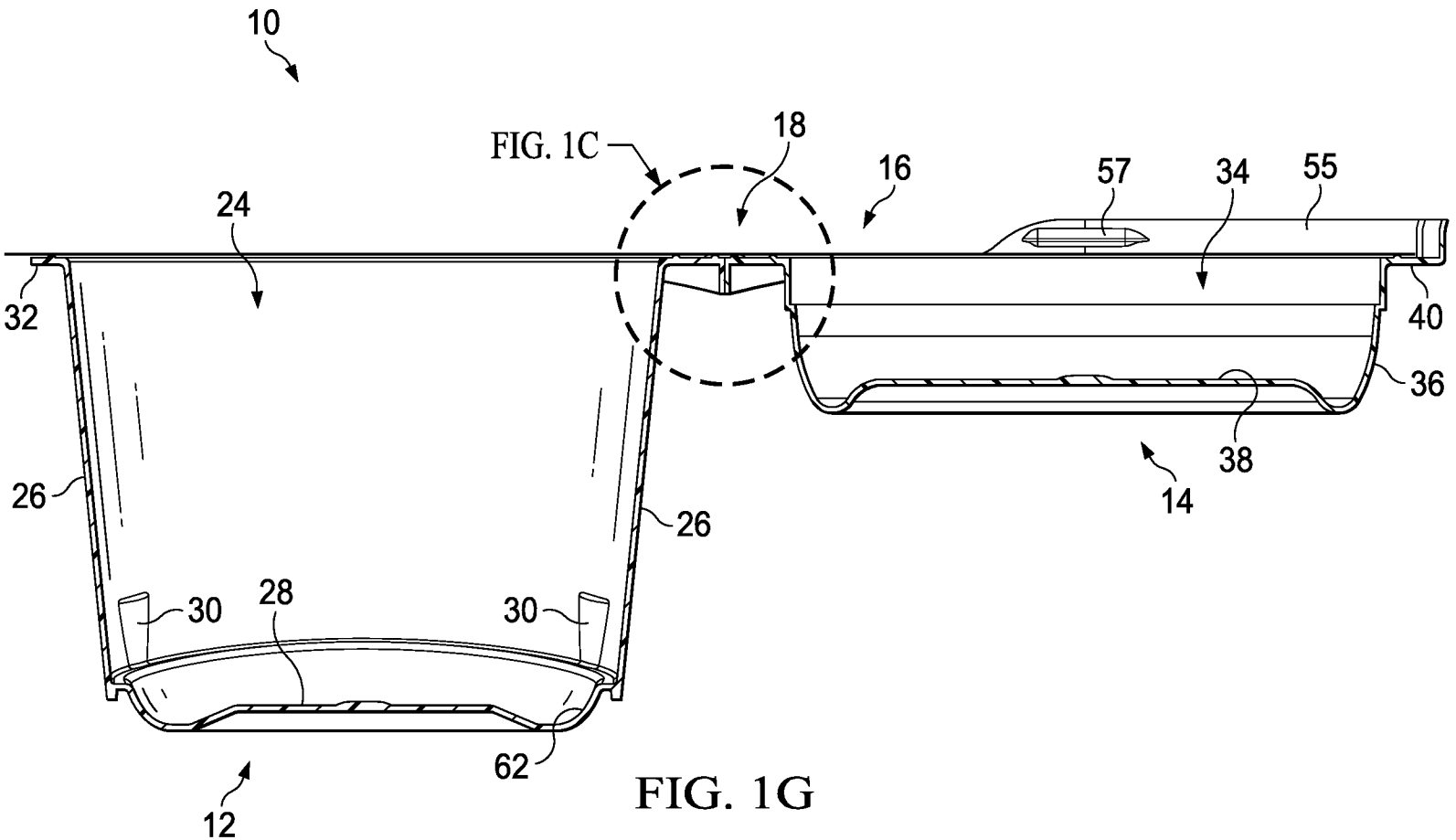
FIGS. 1G and 1H are a cross section and a side, elevation view of the food containment assembly shown in FIG. 1A according to the teachings of the present disclosure.

Reference is made to FIGS. 1A-1I which illustrate various views of a food containment assembly 10. The assembly 10 is formed of separate food containers or cups joined by a seal sheet hinge 18. According to one embodiment, the seal sheet forming the hinge may be a foil material, and thus may be referred to as foil and the hinge may be referred to as a foil hinge. A primary cup 12 is disposed adjacent a secondary cup 14 and a seal sheet 16 is adhered to a sealing flange portion of the cups, as described in more detail below. The seal sheet 16 spans the flanges of the cups 12, 14 and thereby joins the primary cup 12 to the secondary cup 14. The seal sheet hinge 18 facilitates rotation of the secondary cup 14 with respect to the primary cup 12. For example, a counterclockwise rotation of the secondary cup 14 from the orientation shown in FIG. 1G results in the inverted orientation of the secondary cup 14 shown in FIG. 1H. The seal sheet hinge 18 together with features associated with the sealing flanges also holds the secondary cup 14 in a side-by-side configuration with the primary cup 12, as shown in FIG. 1G.

Figure 1H:
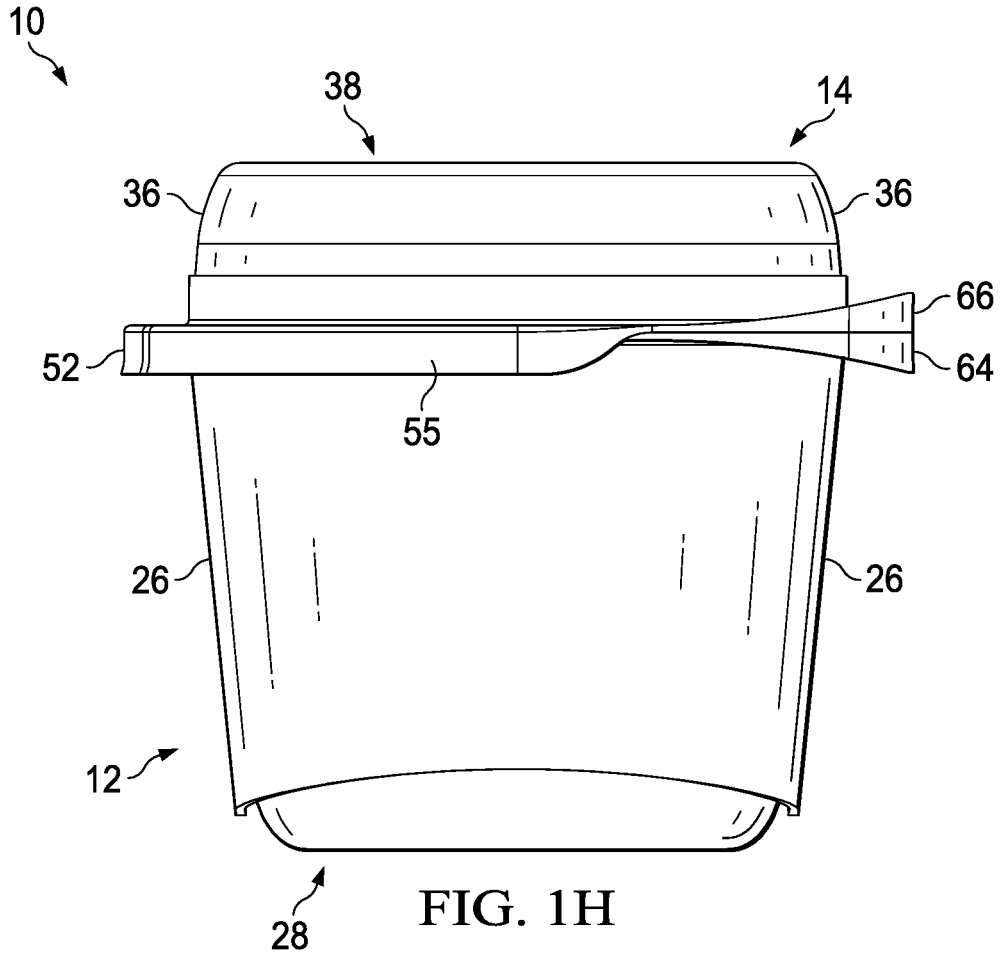
Figure 8:
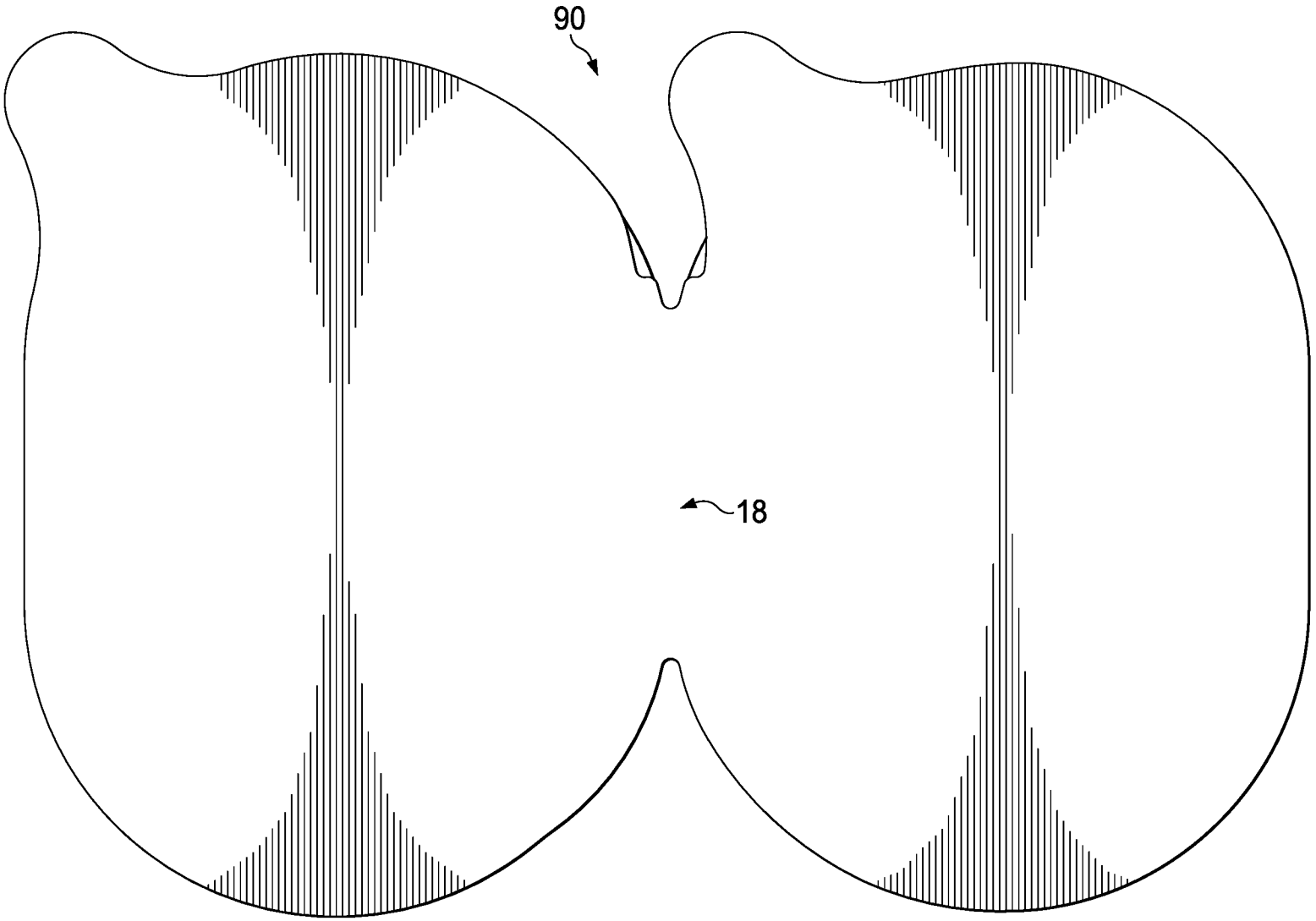
FIGS. 8, 9, and 10 are various views of an alternate embodiment of a food containment assembly employing two primary cups.
Figure 9:
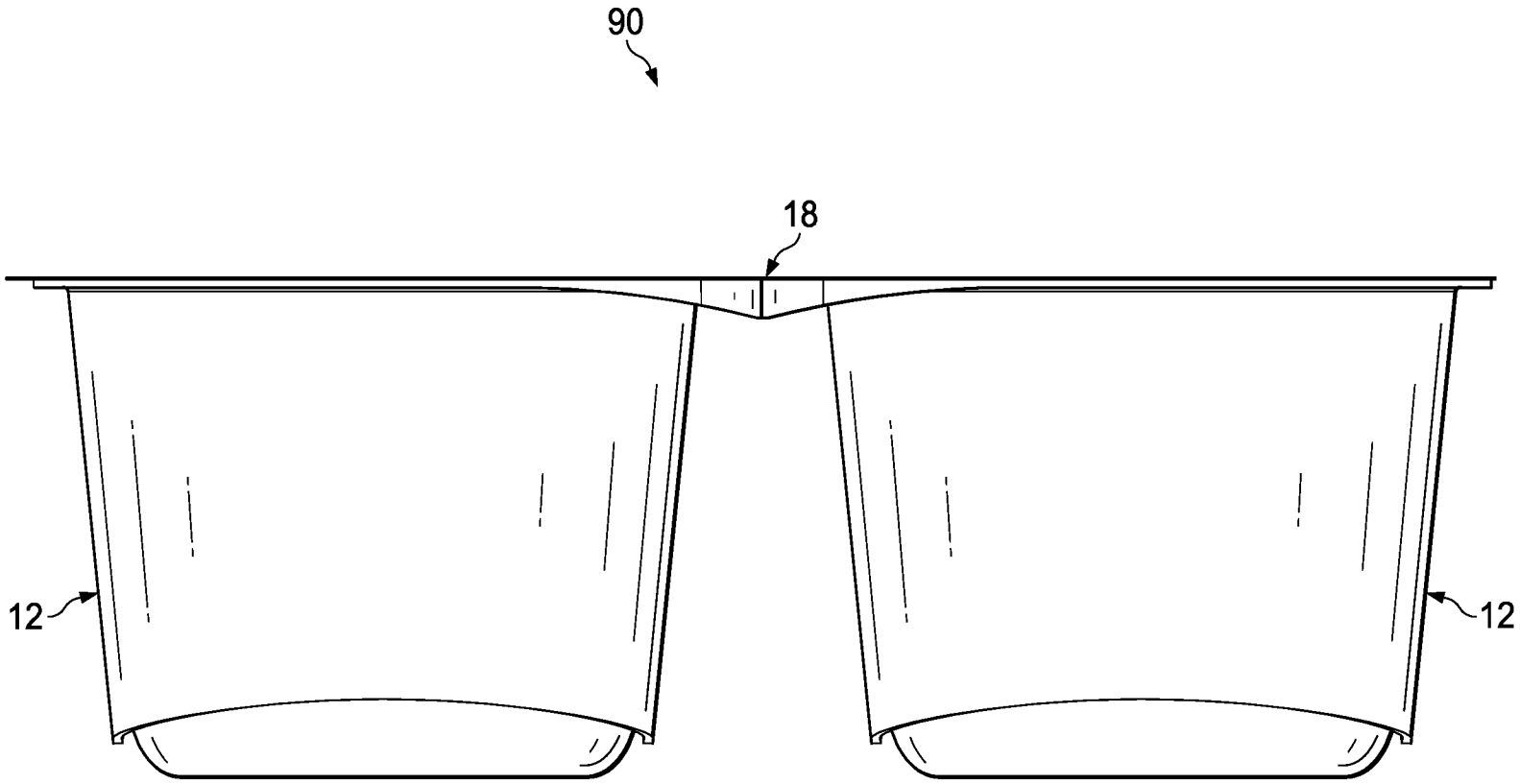
Figure 10:
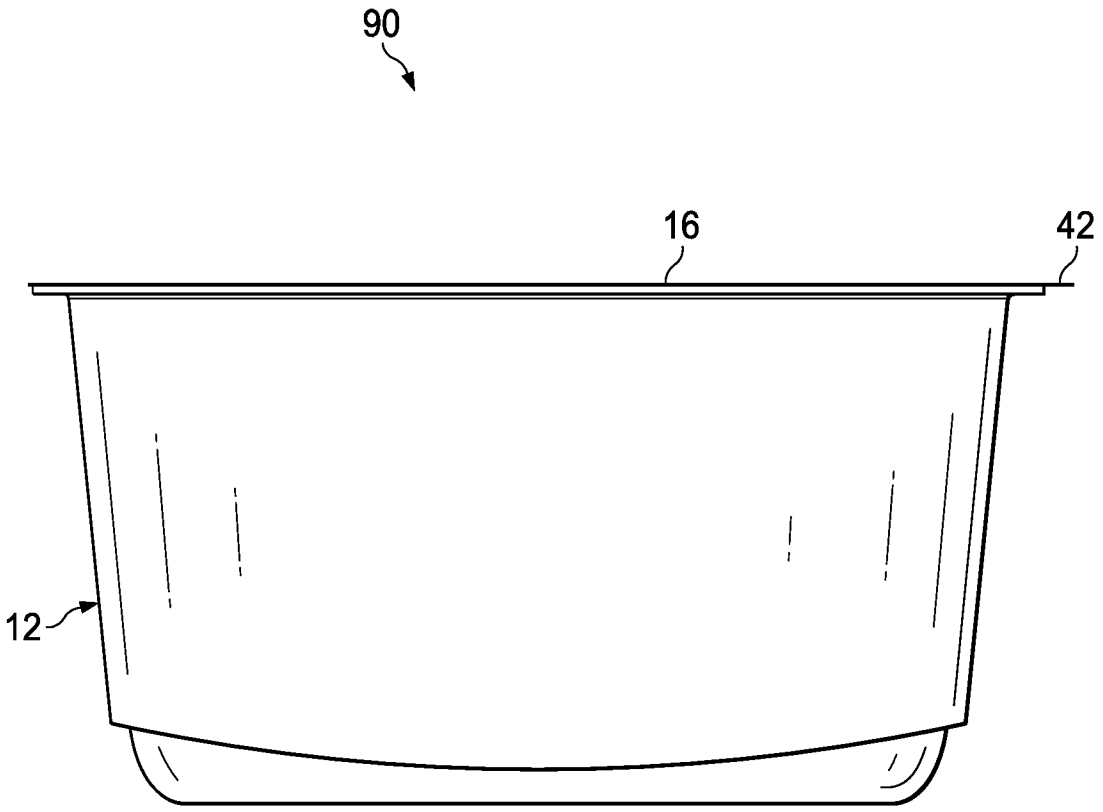
Figure 11A:
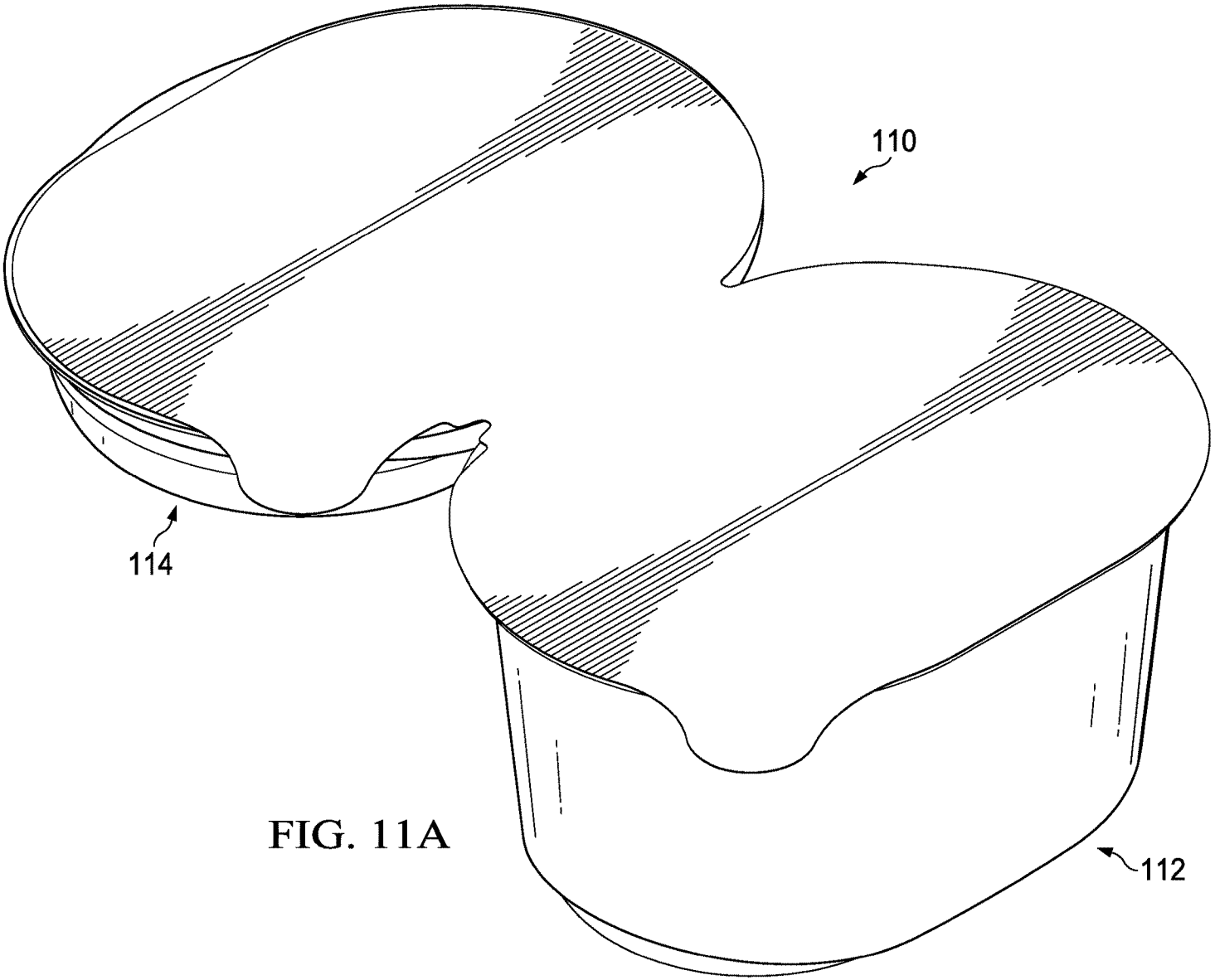
FIG. 11A is a perspective view of an alternate embodiment of a food containment assembly according to the teachings of the present disclosure.
Figure 11B:
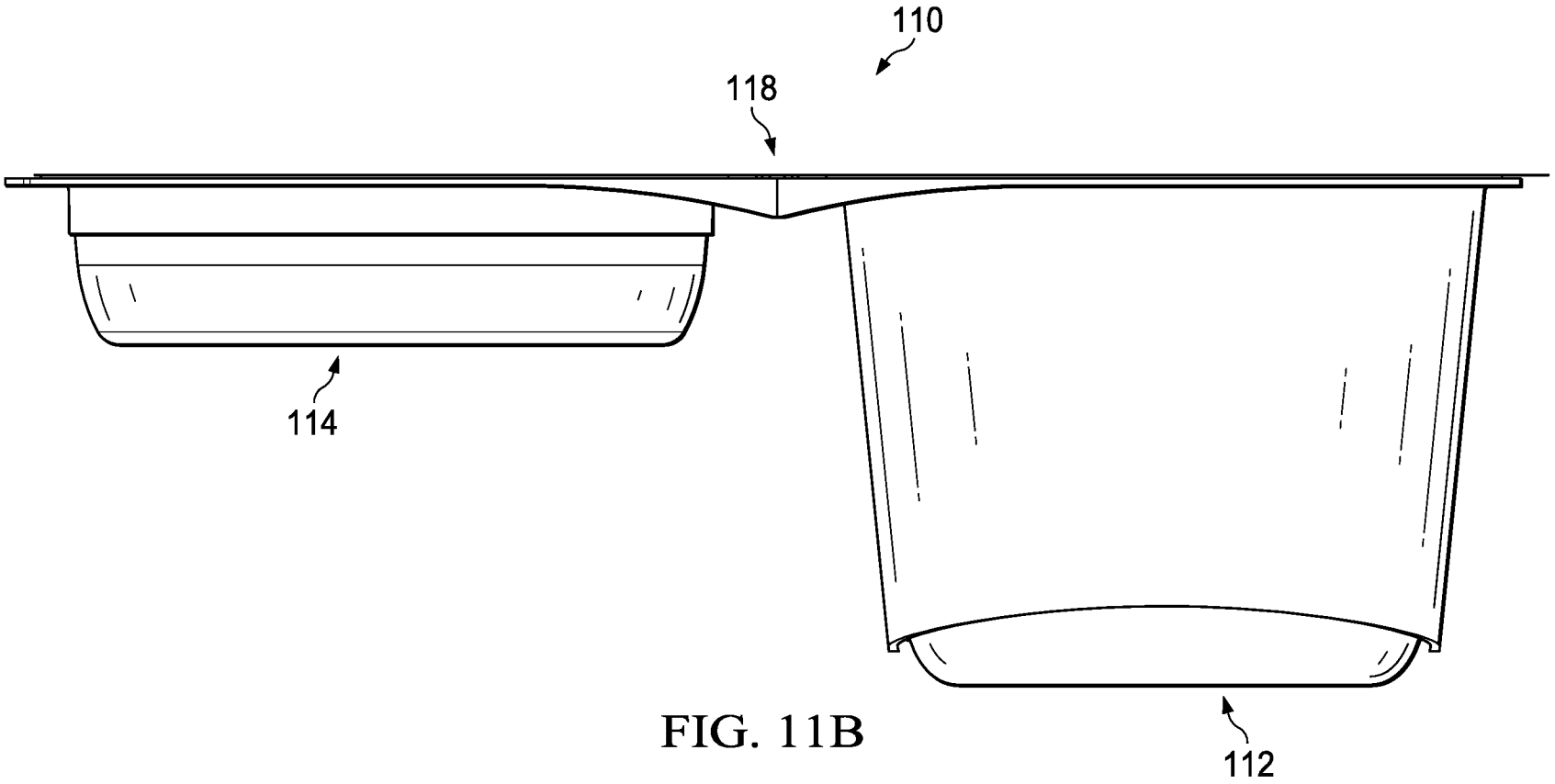
FIG. 11B is a front elevation view of the food containment assembly shown in FIG. 11A, the rear elevation view being a mirror image thereof.
Figure 11C:
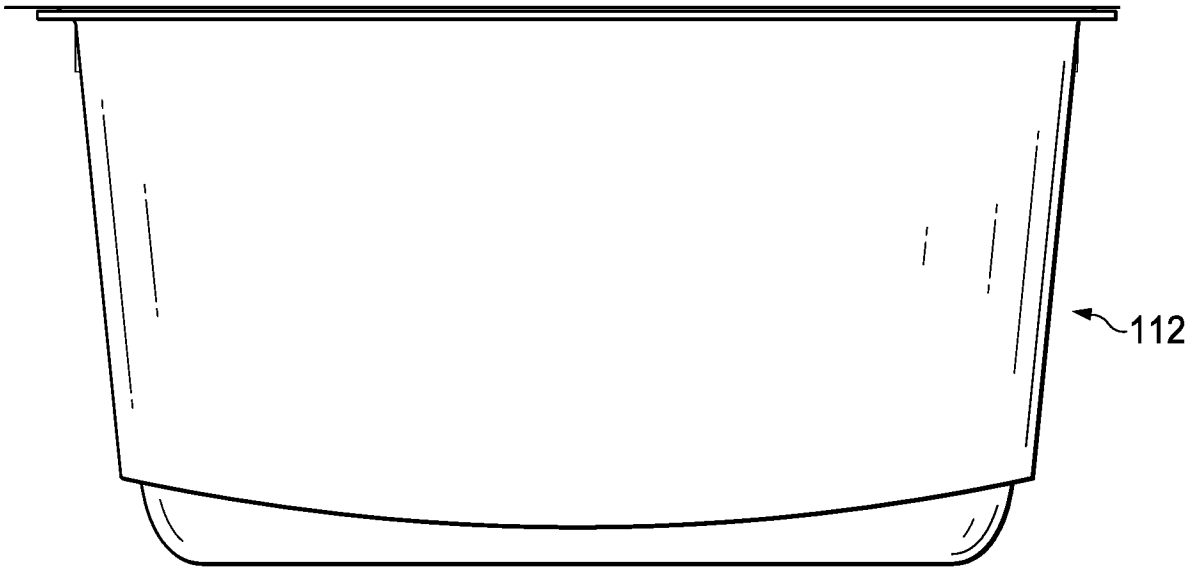
FIG. 11C is a right side view of the food containment assembly shown in FIG. 11A.
Figure 11D:
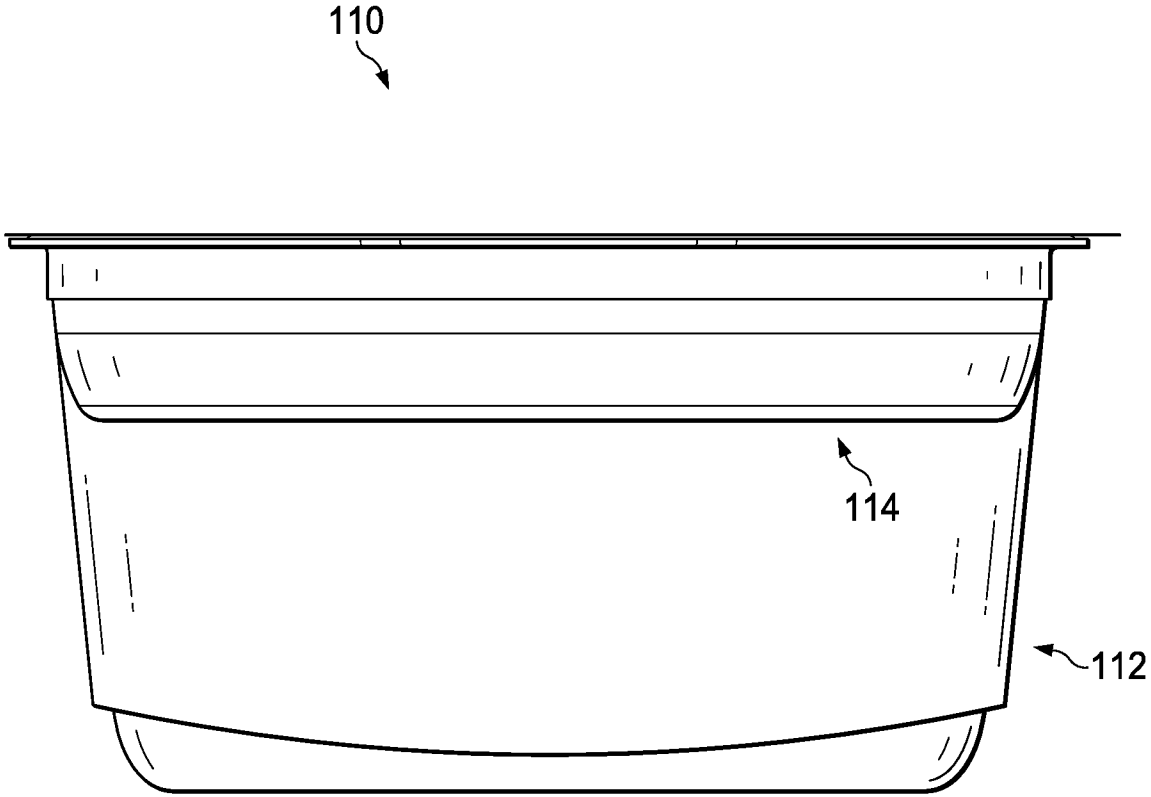
FIG. 11D is a left side view of the food containment assembly shown in FIG. 11A.
Figure 11E:
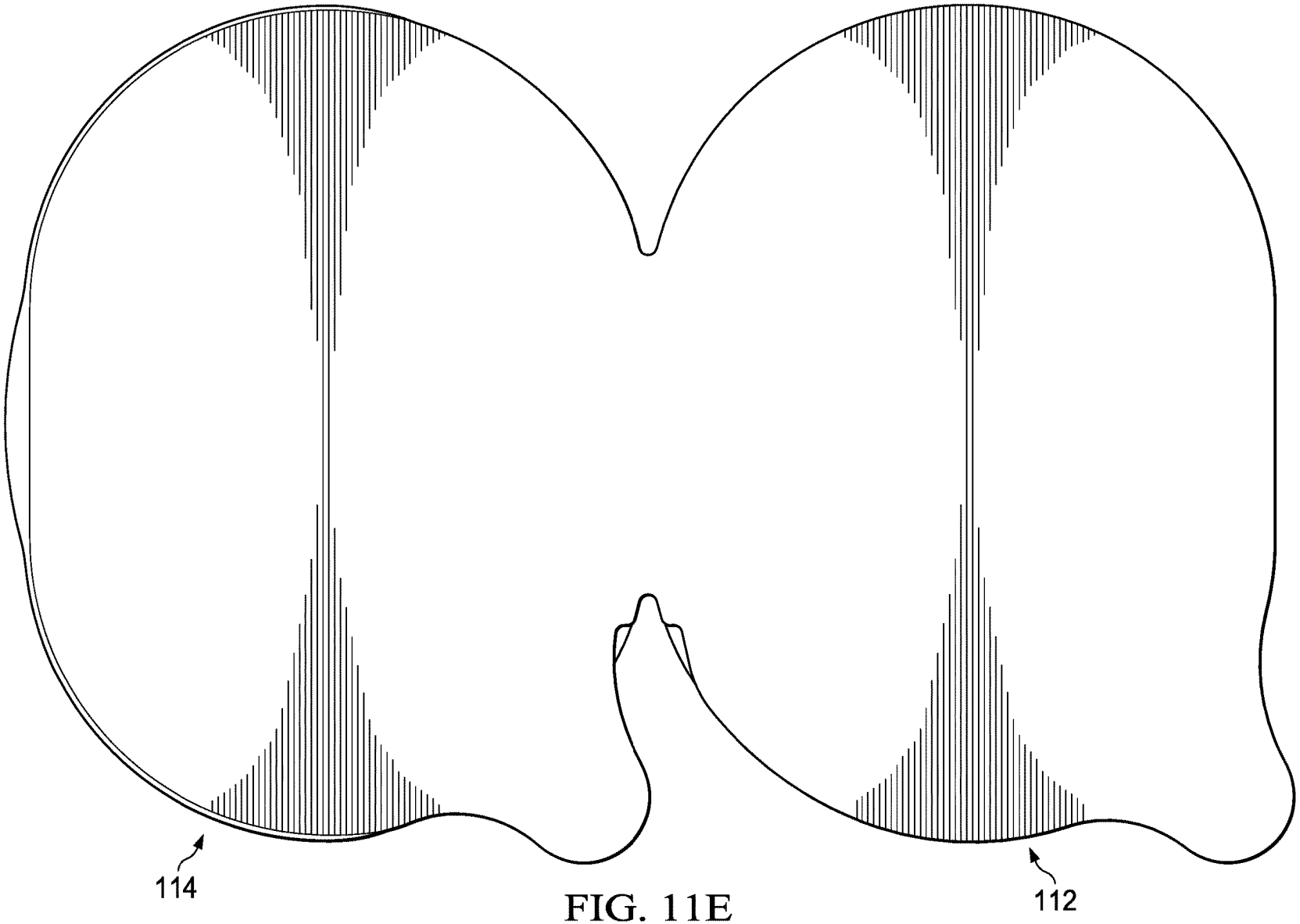
FIG. 11E is a top plan view of the food containment assembly shown in FIG. 11A.
Figure 11F:
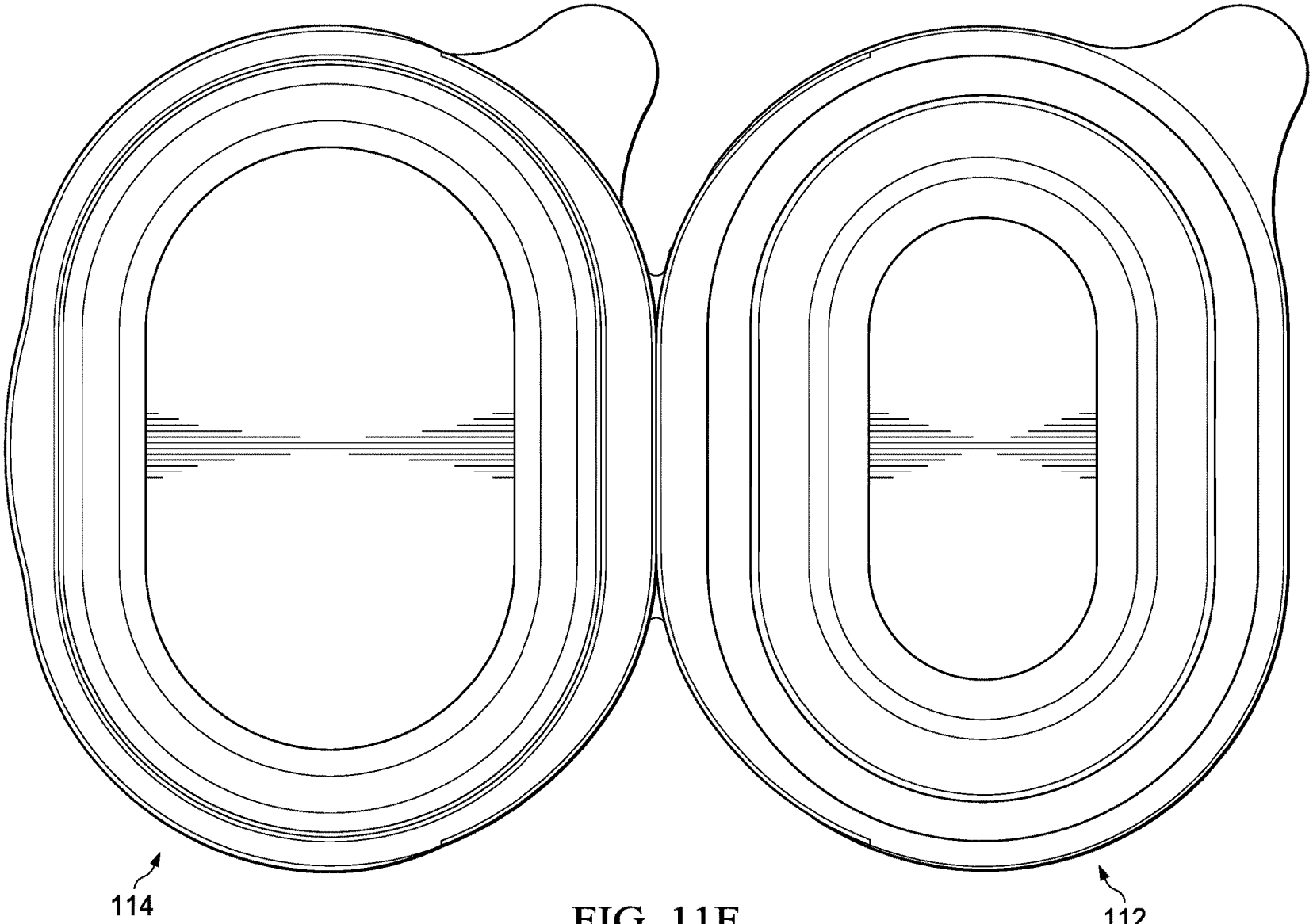
FIG. 11F is a bottom plan view of the food containment assembly shown in FIG. 11A.
Figure 11G:
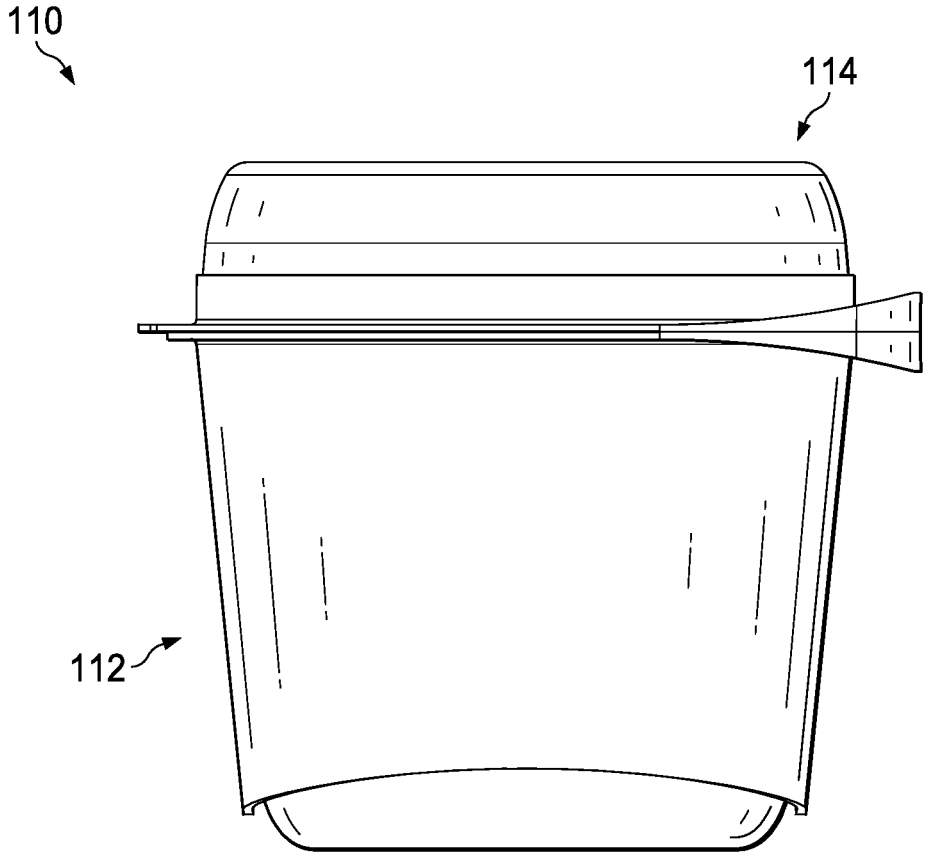
FIG. 11G is a front elevation view of a face-to-face orientation of the assembly shown in FIG. 11A, the rear elevation view being a mirror image thereof.

FIG. 1G is a cross-section, elevation view of the primary and secondary cups 12, 14 in a side-by-side configuration. FIG. 1H is an elevation view of the secondary cup 14 rotated 180 degrees about the seal sheet hinge 18 such that a seal sheet face 20 (see FIG. 2A) of the secondary cup 14 contacts the seal sheet face 22 (see FIG. 2A) of the primary cup 12. According to an alternate embodiment, the primary cup 12 may be substantially similar in size, or even identical to the secondary cup 14, as shown in FIGS. 8-10. Thus, a dairy product, such as cottage cheese, can be provided using one packaging process and production line to provide a larger size primary cup 12 filled with cottage cheese or other dairy product and a smaller size secondary cup 14 filled with fruit or other liquid/semi-solid food or a dry/solid food, such as granola. And the same packaging process and production line can be used to provide two seal sheet hinge-joined single-serve, same-sized cups of cottage cheese.

The primary cup 12 and the secondary cup 14 are formed of a polymeric material, for example polypropylene. Any suitable method for forming the cups 12, 14 is contemplated by the present disclosure including injection molding and thermoforming. The cups 12, 14 are generally thin-walled polymeric parts and are intended to be disposable. As is known in the polymeric fabrication art, the wall of the polymeric thin-walled part has a generally uniform thickness. The wall of the generally uniform thickness thin-walled cups 12, 14 may be in a range of 0.5-1.25 millimeters, for example approximately 0.6 millimeters.

The seal sheet 16 may be any suitable sheet of material. According to one embodiment, the seal sheet 16 is a sheet multi-layer material with an aluminum foil base and a polyethylene layer that is designed to be easy to peel away from the cups 12, 14. According to certain embodiments, the seal sheet 16 may have a thickness of approximately 76 microns. The seal sheet 16 may also have an increased tear resistance, which may reduce instances of unintentional tearing of the hinge 18 resulting in separation of the secondary cup 14 from the primary cup 12. According to an alternate embodiment, the seal sheet 16 may be formed of a single or multi-layer film including a polymeric material and/or a metallic layer. The seal sheet 16 may be formed of a material other than foil. The sheets may be precut to the shape shown in FIG. 2A. The seal sheet 16 may be applied to the primary cup 12 and the secondary cup 14 using any suitable adhesive, including a heat activated adhesive or a glue-based adhesive.

The primary cup 12 includes a cavity 24 formed by perimeter walls 26 and a bottom wall 28. According to certain embodiments, internal anti-nesting protrusions 30 extend from the interior of the perimeter walls 26 proximate a floor of the cavity 24. The anti-nesting features 30 function to allow empty, nested cups to be easily separated from each other by processing equipment.

Figure 2B:
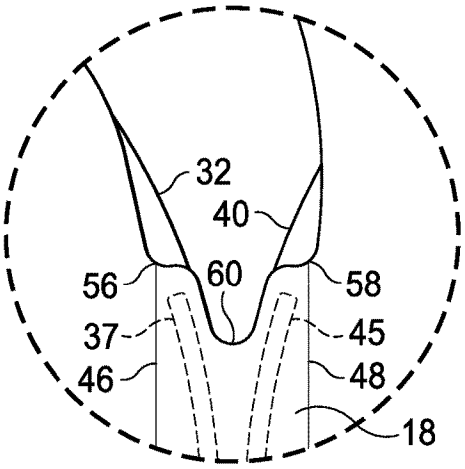
FIGS. 2B and 2C are respective detail views showing topside and underside views of a seal sheet tear initiation portion of the food containment assembly.
Figure 2C:
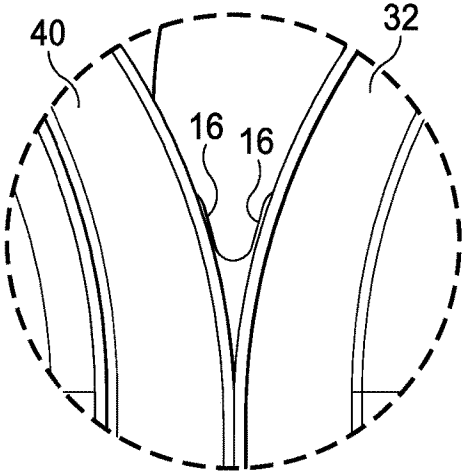
Figure 2A:
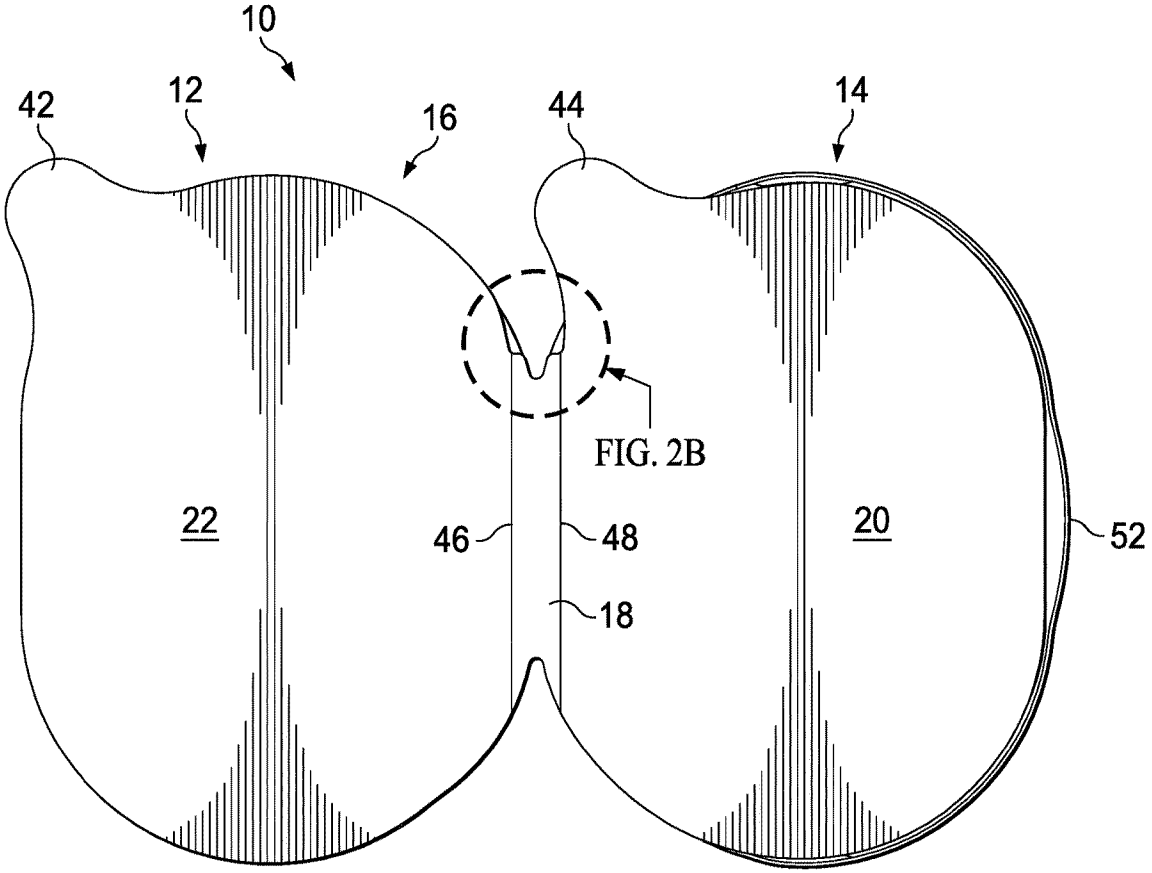
FIG. 2A is a top plan view of a food containment assembly.
Figure 3:
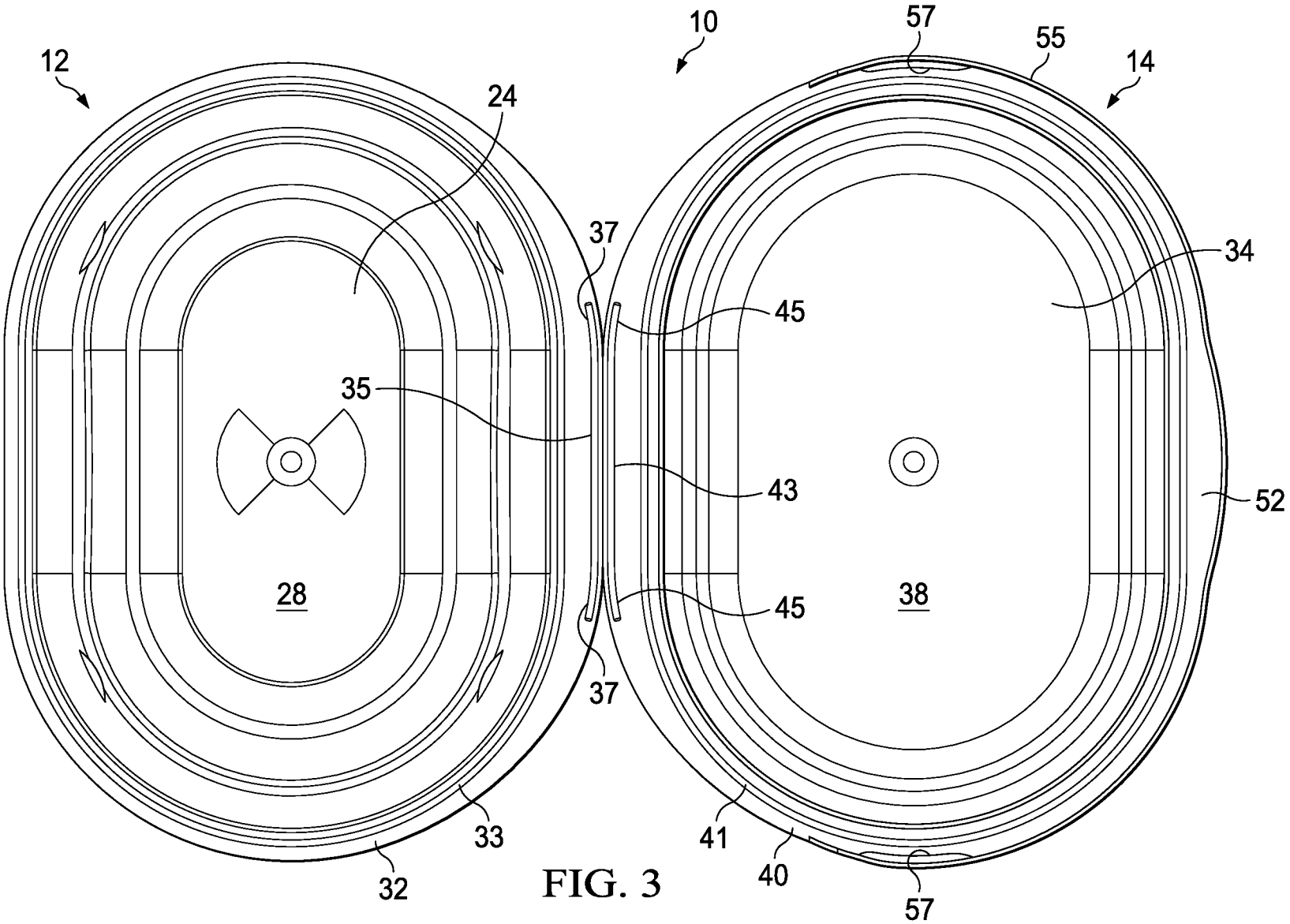
FIG. 3 is a top, plan view of the food containment assembly of FIG. 2A prior to placement of the seal sheet.

With reference to FIG. 3, the primary cup 12 has a racetrack shape. That is, at longitudinal ends, generally semicircular portions are disposed. The semicircular portions are joined by a straight portion at each lateral side of the cup 12. The sealing flange 32 is an asymmetric flange that is disposed at an upper perimeter of the primary cup 12. The asymmetry allows for a larger surface area for sealing the seal sheet 16 to create the seal sheet hinge 18. The larger surface area also accommodates slight imprecision in the application of a cutter or blade that creates slit lines 46, 48 shown and discussed with respect to FIGS. 2A and 2B.

A cavity seal bead 33 extends vertically from the perimeter sealing flange 32 and encircles the primary cavity 24. The cavity seal bead 33 of the primary cup 12 provides increased surface area for the seal sheet 16 to adhere to seal in the contents and the freshness of the contents of the primary cup 12. The cavity seal bead 33 also concentrates and increases a sealing pressure applied to the seal sheet 16 at the location where the seal sheet 16 contacts the cavity seal bead 33. Thus, a stronger seal is created to seal the contents in the cavity 24.

A hinge seal bead 35 also extends vertically from the perimeter sealing flange 32 of the primary cup 12. The hinge seal bead 35 is disposed offset a straight portion of the cavity seal bead 33 at a location adjacent to the secondary cup 14, when the cups are assembled by the seal sheet 16. Ends 37 of the hinge seal bead 35 wrap partly around the curved portion of the perimeter sealing flange 32. The curved extension ends 37 of the hinge seal bead 35 concentrate tearing energy at a desired location of the seal sheet hinge 18, as described in further detail below.

The secondary cup 14 includes a cavity 34 formed by perimeter walls 36 and a bottom wall 38. The secondary cup 14 also includes a perimeter sealing flange 40. The secondary cup 14 and the perimeter sealing flange 40 is also racetrack shaped. The perimeter sealing flange 40 may be an asymmetric flange that is disposed at an upper perimeter of the secondary cup 14. The asymmetry allows for a larger surface area for sealing the seal sheet 16 to create the seal sheet hinge 18.

The secondary cup 14 also includes a cavity seal bead 41 that extends vertically from the perimeter sealing flange 40 and encircles the secondary cavity 34. The cavity seal bead 41 of the secondary cup 14 provides increased surface area for the seal sheet 16 to adhere to seal in the contents and the freshness of the contents of the secondary cup 14. The cavity seal bead 41 also concentrates and increases a sealing pressure applied to the seal sheet 16 at the location where the seal sheet 16 contacts the cavity seal bead 41. Thus, a stronger seal is created to seal the contents in the cavity 34.

A hinge seal bead 43 also extends vertically from the perimeter sealing flange 40 of the secondary cup 14. The hinge seal bead 43 is disposed offset a straight portion of the cavity seal bead 41 at a location adjacent to the primary cup 12, when the cups are assembled by the seal sheet 16. The hinge seal bead 43 concentrates and increases a pressure applied to the seal sheet 16 at the location where the seal sheet 16 contacts the hinge seal bead 43. Similarly, the hinge seal bead 35 of the primary cup 12 concentrates a pressure applied to the seal sheet 16 at the location where the seal sheet 16 contacts that hinge seal bead 35. Thus, a stronger seal is created to form the seal sheet hinge 18. Ends 45 of the hinge seal bead 43 wrap partly around the curved portion of the perimeter sealing flange 40 and function to concentrate tearing energy at a desired location of the seal sheet hinge 18, as described in more detail below.

Figure 5:
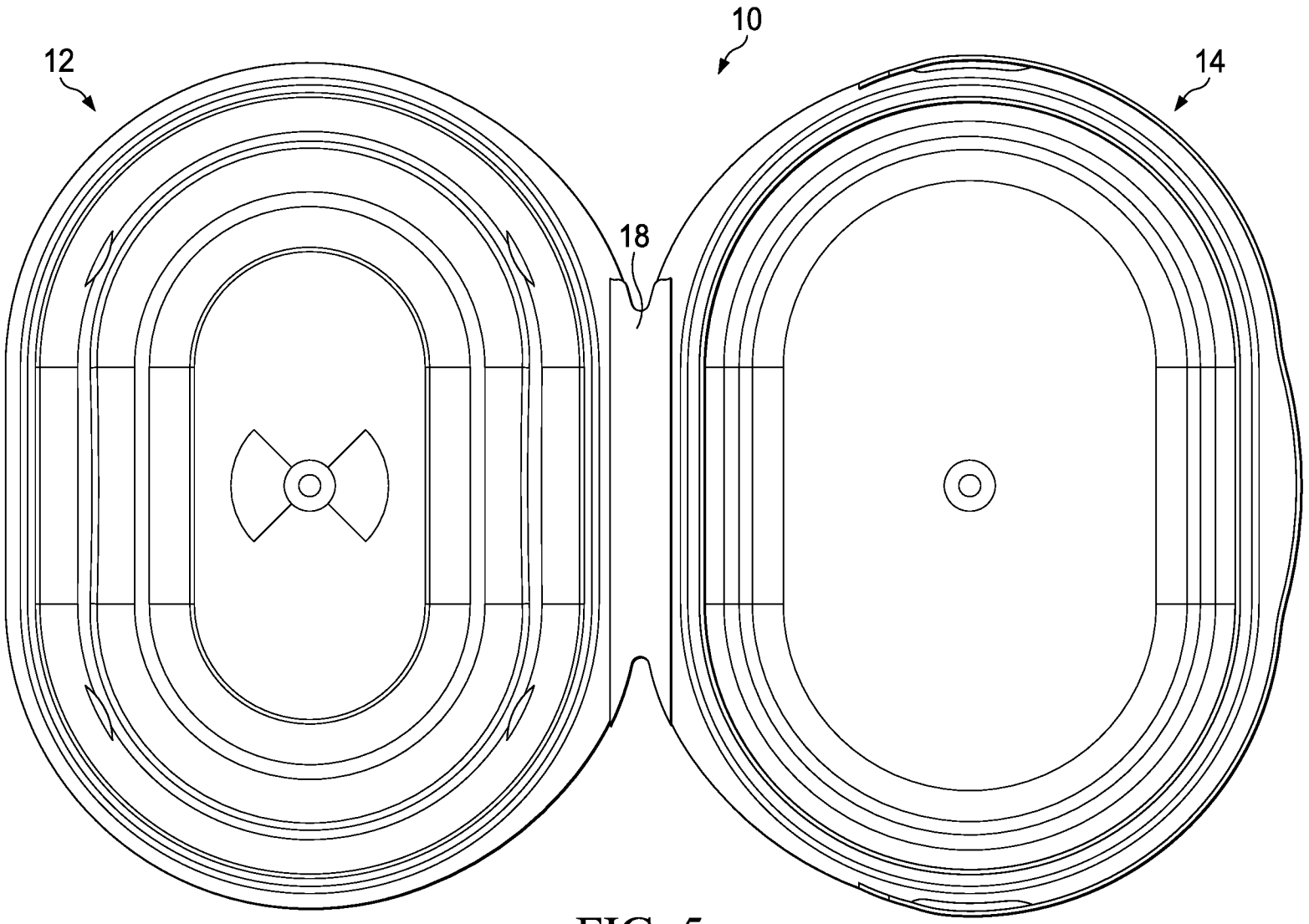
FIG. 5 is a top, plan view of the food containment assembly with both the portions associated with the primary and secondary cups removed with the seal sheet hinge undisturbed and intact.

The hinge seal beads 35, 43 maintain the integrity of the seal sheet hinge 18. The seal sheet hinge 18 is shown in FIG. 5, in which the seal sheet 16 is removed from both the primary cavity seal bead 33 and the secondary cavity seal bead 41, but the adherence of the seal sheet 16 to the primary hinge seal bead 35 and the secondary hinge seal bead 43 is maintained and undisturbed.

Reference is made to FIGS. 2A and 2B. FIG. 2A is an overhead, plan view of the food containment assembly 10. FIG. 2B is a detail showing certain tearing features of the seal sheet 16. The seal sheet 16 is applied to the primary cup 12 and the secondary cup 14 as shown in FIG. 2A. A primary lift tab portion 42 extends from the primary seal face 22, and a secondary lift tab portion 44 extends from the secondary seal face 20. The primary lift tab portion 42 is configured to allow a consumer to peel the seal sheet 16 associated with the primary cup 12 along a primary slit line 46 and remove the seal sheet 16 from the primary cavity seal bead 33 of the primary cup 12 without disturbing the seal sheet hinge 18. As such, the primary slit line 46 is formed between the primary cavity seal bead 33 and the primary hinge seal bead 35 in order to locate the tear of the seal sheet 16 between the primary cavity seal bead 33 and the primary hinge seal bead 35.

The secondary lift tab portion 44 is configured to allow a consumer to peel the secondary seal face 20 portion of the seal sheet 16 along a secondary slit line 48 from the secondary cup 14 without disturbing the seal sheet hinge 18. The consumer may peel the seal sheet 16 along the secondary slit line 48 and remove the seal sheet 16 from the secondary cavity seal bead 41 of the secondary cup 14 without disturbing the seal sheet hinge 18. As such, the secondary slit line 48 is formed between the secondary cavity seal bead 41 and the secondary hinge seal bead 43 in order to locate the tear of the seal sheet 16 between the secondary cavity seal bead 41 and the secondary hinge seal bead 43.

In an alternate embodiment, one of both slit lines may be replaced with a perforation line, a linear slit, a score line, or other suitable feature to facilitate tearing of the seal sheet 16 at a predetermined, precise location. According to one embodiment, the seal sheet 16 may be applied to the primary and secondary cups 12, 14, and then one or more blades may be used to cut or otherwise form the primary and secondary slits 46, 48. The primary and secondary slits 46, 48 may extend fully or only partially along the straight portions of the respective sealing flanges 32, 40. According to an alternate embodiment, first and second perforations may be preformed in the seal sheet 16 before applying to the primary and secondary cups 12, 14.

The sealing flange 32 of the primary cup 12 is large (i.e. wide) enough to accommodate tolerances in positioning of a blade to ensure that the blade cuts a portion of the seal sheet 18 between the cavity seal bead 33 and the hinge seal bead 35 of the primary cup 12. Similarly, the sealing flange 34 of the secondary cup 14 is large (i.e. wide) enough to accommodate tolerances in the positioning of a blade to ensure that the blade cuts a portion of the seal sheet 18 between the secondary cavity seal bead 41 and the secondary hinge seal bead 43.

Figure 4:
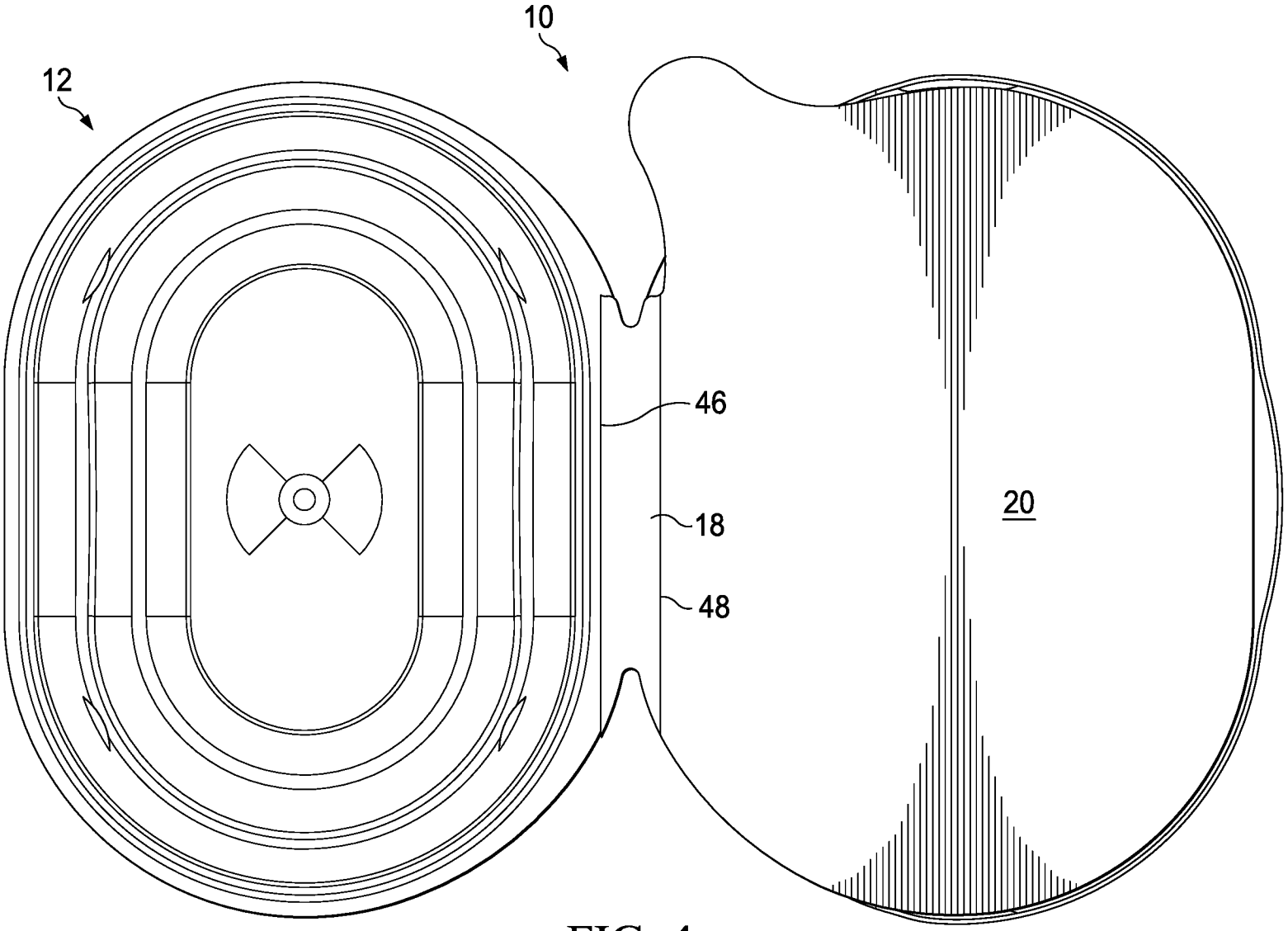
FIG. 4 is a top, plan view of the food containment assembly with the portion of the seal sheet associated with a primary cup removed.

In this manner, a consumer may remove the seal sheet 16 with respect to both the primary cup 12 and the secondary cup 14 to allow access to their respective food contents, but maintain the seal sheet hinge 18 portion of the seal sheet 16 that joins the primary cup 12 to the secondary cup 14. FIG. 4 illustrates the assembly 10 with only the seal sheet 16 associated with the primary cup 12 removed along the primary slit line 46. FIG. 5 illustrates the seal sheet 16 associated with both the primary cup 12 and the secondary cup 14 removed along respective slit lines 46, 48. The intact seal sheet hinge 18 maintains the secondary cup 14 joined to the primary cup 12.

The hinge 18 may facilitate the consumer rotating the secondary cup 14 to dump the full contents of the secondary up 14 into the primary cup 12. The seal sheet hinge 18 also facilitates a user employing the side-by-side joined configuration shown in FIG. 5 of the primary and secondary cups 12, 14 to spoon out a bite-sized portion from the secondary cup 14, which can then be inserted into the primary cup 12 to combine the two food products in the spoon for immediate consumption.

According to an embodiment, a skirt 55 extends from a portion of the sealing flange 40 of the secondary cup 14. Alternatively, the skirt 55 may extend from the sealing flange 32 of the primary cup 12. The skirt 55 includes a pair of protrusions or prongs 57 that extend from the skirt 55. The protrusions 57 facilitate a snap fit with the sealing flange 32 of the primary cup 12. When the secondary cup 14 is rotated 180 degrees such that the secondary seal sheet face 20 abuts the primary seal sheet face 22, the skirt 55 overlaps a portion of the primary sealing flange 32. The sealing flange 32 of the primary cup 12 elastically deforms the skirt 55 and the primary sealing flange 32 (and/or the prongs 57 elastically deform the flange 32) is captured between the protrusions 57 and the secondary sealing flange 40. According to one embodiment, the skirt 55 has two protrusions 57 disposed on opposite sides of the secondary sealing flange 40, and therefore the primary sealing flange 32 is constrained between the protrusions 57 and the secondary sealing flange 40 at least at two separate locations.

In the illustrated embodiment, the skirt 55 extends upward from about half of the secondary sealing flange 40. In this manner, the seal sheet 16 can be sealed to the primary and secondary sealing flanges 32, 40 including the seal beads of each, and the lift tab 44 portion of the seal sheet 16 can extend beyond and outside of the skirt 55. Prior to snapping the secondary cup 14 to the primary cup 12, the lift/pull tabs 42, 44 of each of the primary cup 12 and the secondary cup 14 can be folded over such that the tabs are within the periphery of the cups 12, 14.

The user applies a force to a lifting portion 52 to rotate the secondary cup 14 with respect to the primary cup 12 and thereby unclips the flange 32 from the clip portions 57 of the skirt 55. The clip connection between the skirt 55 and the sealing flange 32 of the primary cup 12 allow the cups 12, 14 to be transported and displayed in the face-to-face orientation shown in FIG. 1H without additional packaging.

According to an alternate embodiment, a small amount of liquid adhesive or glue may be dispensed on a portion of the seal sheet 16, for example on the primary seal face 22 and/or on the secondary seal face 20. The glue may be dispensed in any suitable shape, such as a drop, a line and the like. The present disclosure contemplates glue disposed on any portion or over the entire surface of the seal sheet 16. This liquid adhesive maintains the secondary cup 14 and the primary cup 12 in seal face-to-face configuration shown in FIG. 1H. When the consumer desires to consume the product, the consumer lifts the secondary cup 14 by the lift portion 52 and breaks the bond created by the small amount of glue. The quantity of glue is selected to avoid creating a messy or otherwise undesirable appearance of the food containment assembly 10 while maintaining suitable adherence between the two cups.

Reference is made to FIG. 2B, which is a detail of FIG. 2A showing geometry of the seal sheet 16 that facilitates removal of the first seal face 22 and the second seal face 20 and fracturing of the seal sheet 16 to separate the secondary cup 14 from the primary cup 12. The primary cup slit line 46 is formed in the seal sheet 16. The secondary cup slit line 48 is also formed in the seal sheet 16. According to one embodiment, the primary cup slit line 46 and the secondary cup slit line 48 are formed subsequently to applying the seal sheet 16 to the primary and secondary cups 12, 14. This formation of the slit lines 46, 48 enables the seal sheet 16 associated with the primary cup 12 or the seal sheet 16 associated with the secondary cup 14 to be removed while maintaining the seal sheet hinge 18 intact. According to an alternate embodiment, score or perforation lines 46, 48 may be formed in the seal sheet 16 prior to applying the seal to the cups 12, 14.

The seal sheet 16 may include a primary cup notch 56 and a secondary cup notch 58. The primary cup notch 56 is a portion of the seal 16 that is arcuate to a certain radius. The arcuate notch 56 concentrates and directs the force created by lifting and pulling back the primary seal portion by the lift tab 42 at the location of the primary cup slit line 46. Similarly, the secondary cup notch 58 concentrates and directs the force created by lifting and pulling back the secondary lift tab 44 at the secondary cup slit line 48. This allows the portions of the seal sheet 16 to be separated from the respective cups 12, 14 without disturbing the seal sheet hinge 18. That is, the seal sheet hinge 18 remains intact to maintain the junction of the primary cup 12 and the secondary cup 14, as shown in FIG. 5. According to certain embodiments, each of the notches 56, 58 has a radius in a range of 0.2-1 millimeter, for example 0.5 millimeters.

The primary cup notch 56 and the secondary cup notch 58, as shown in detail in FIG. 2B, also ensure that imprecision in placement of the seal sheet 16 does not result in the seal sheet 16 hanging over the respective seal flanges 32, 40, such that a portion of the seal sheet 16 floats. Formation of the slit lines 46, 48 is facilitated by the flanges 32, 40 opposing a blade as it cuts through the seal sheet 16 along the slit lines 46, 48. If a portion of the seal sheet 16 hangs over the flanges 32, 40, it may not be fully cut, or cut at all, by the blade because the blade may merely deflect the floating seal sheet 16, as opposed to cutting completely through the seal sheet 16. Thus, the primary cup notch 56 and the secondary cup notch 58 ensure that the slit lines 46, 48 extend completely to the perimeter of the seal sheet 16. A slit that does not extend completely to the perimeter of the seal sheet may not tear along the slit lines 46, 48, when a consumer attempts to remove the portion of the seal sheet 16 covering either the primary cup 12 or the secondary cup 14.

A portion of the sealing flanges 32, 40 may be exposed in the location of the primary cup notch 56 and the secondary cup notch 58 respectively. Also, as shown in FIG. 2C, which is the underside view corresponding to FIG. 2B, a portion of the seal sheet 16 may slightly overhang the respective sealing flanges 32, 40. According to certain embodiments, the seal sheet 16 may overhang 3-8 millimeters.

A hinge tear notch 60 in the seal sheet 16 is disposed at a junction of the primary cup 12 and the secondary cup 14. The hinge tear notch 60 concentrates and directs forces created by grasping and twisting the cups 12, 14 with respect to each other at the location where the two cups 12, 14 are abutted and joined by the seal sheet hinge 18. In this manner, the secondary cup 14 may be completely separated from the primary cup 12 by tearing the seal sheet hinge 18, with the tear initiating at the hinge tear notch 60. The integrity of the seal sheet hinge 18 during handling may be maintained because there is no perforation, score, or slit to facilitate tearing through the foil. Rather, the hinge tear notch 60 locates the forces to allow the seal sheet hinge 18 to be easily torn and fractured without a perforation. According to one embodiment, a radius of the hinge tear notch 60 is in a range of 0.1-1 millimeter, for example 0.4 millimeters.

With reference to FIG. 2B, the end extension 37 of the hinge seal bead 35 extends beyond the radius of the hinge tear notch 60. Similarly, the end extension 45 of the secondary hinge seal bead 43 also extends beyond the radius of the hinge tear notch 60. The end extensions 37, 45 are shown in hidden line in FIG. 2B with the seal sheet 18 in its optimal placement. Extending the ends 37, 45 of the hinge seal beads 35, 43 beyond the hinge tear notch 60 functions to concentrate the energy generated when intentionally tearing the hinge seal 18 at the hinge tear notch 60, which makes the secondary cup 14 easier to separate from the primary cup 12. The extension of the ends 37, 45 of the hinge seal beads 35, 43 also functions to maintain the seal at the perimeter of the seal sheet 16 proximate the hinge tear notch 60, such that unintentional lifting of the seal is reduced or eliminated.

Reference is again made to FIG. 3, which is an overhead plan view of the primary cup 12 and the secondary cup 14 in the side-by-side configuration of FIG. 1G without the seal sheet 16. The sealing flanges 32, 40 are disposed around an upper perimeter of the primary cup 12 and the secondary cup 14. The sealing flanges 32, 40 provide a flat surface for the seal sheet 16 to adhere. With reference to FIG. 1G, a bottom wall 28 of the primary cup 12 includes an arcuate surface 62 sized to enable a spoon to be received to collect the food product that might otherwise be retained at a location where the side wall 26 transitions to the bottom wall 28.

Figure 1I:
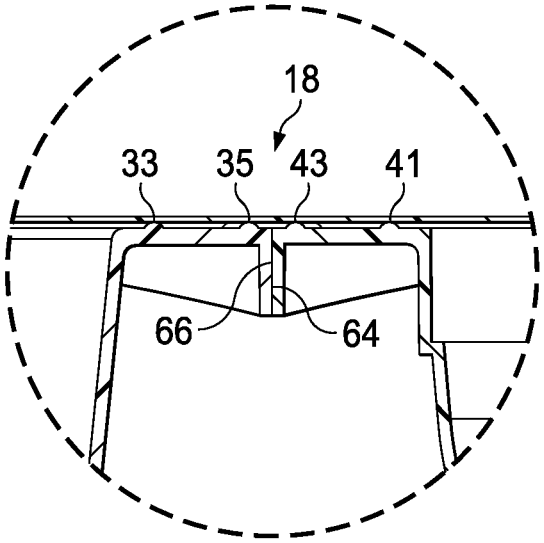
FIG. 1I is a detail view of a seal sheet hinge portion of the food containment assembly of FIGS. 1G and 1H.

Reference is made to FIG. 1I, which is a detail view of FIG. 1G showing features associated with the seal sheet hinge 18. In addition to increased surface area for adherence for the sealing flanges 32, 40 and hinge seal beads 35, 43 proximate the seal sheet hinge 18, each sealing flange 32, 40 includes an overhang wall 64, 66. A primary overhang wall 64 extends generally perpendicularly from the primary sealing flange 32, and a secondary overhang wall 66 extends generally perpendicularly from the secondary sealing flange 40. According to certain embodiments, the primary overhang wall 64 abuts the secondary overhang wall 66, as shown in FIGS. 1G and 1I. Alternatively, there may be a nominal distance between the primary overhang wall 64 and the secondary overhang wall 66 such that the walls 64, 66 do not contact each other. The seal sheet hinge 18 may be stronger if the overhang walls 64, 66 are closer together. Tolerances of the filling and sealing machines as well as the cups 12, 14 themselves may be controlled to ensure that the secondary overhang wall 66 is sufficiently close to the primary overhang wall 64 to form the seal sheet hinge 18.

The overhang walls 64, 66 act as an anti-rotation feature and function to keep the secondary cup 14 generally parallel with the primary cup 12 when the integrity of the seal sheet hinge 18 is maintained. That is, the seal sheet hinge 18 in conjunction with adjacent overhang walls 64, 66 maintain the primary cup 12 and the secondary cup 14 generally parallel, as shown in FIG. 1G. According to one embodiment, the overhang walls 64, 66 have a height in a range of 2-5 millimeters, for example approximately 3.7 millimeters. As shown in FIG. 1H, the overhang walls 64, 66 may be tapered to gradually increase in height as they extend from their respective cups 12, 14.

According to certain embodiments, the primary cup 12 is positioned adjacent with the secondary cup 14, as shown in FIG. 3, and then the two cups 12, 14 are filled with a respective food product, such as cottage cheese in the primary cup 12 and fruit in the secondary cup 14. The seal sheet 16 is applied, heat adhered to the flange, and then the seal sheet 16 is cut to create slit lines 46, 48. According to an alternate embodiment, the cups 12 and 14 may be filled and then disposed in a side-by-side configuration for application of the foils seal 16.

Figure 6:
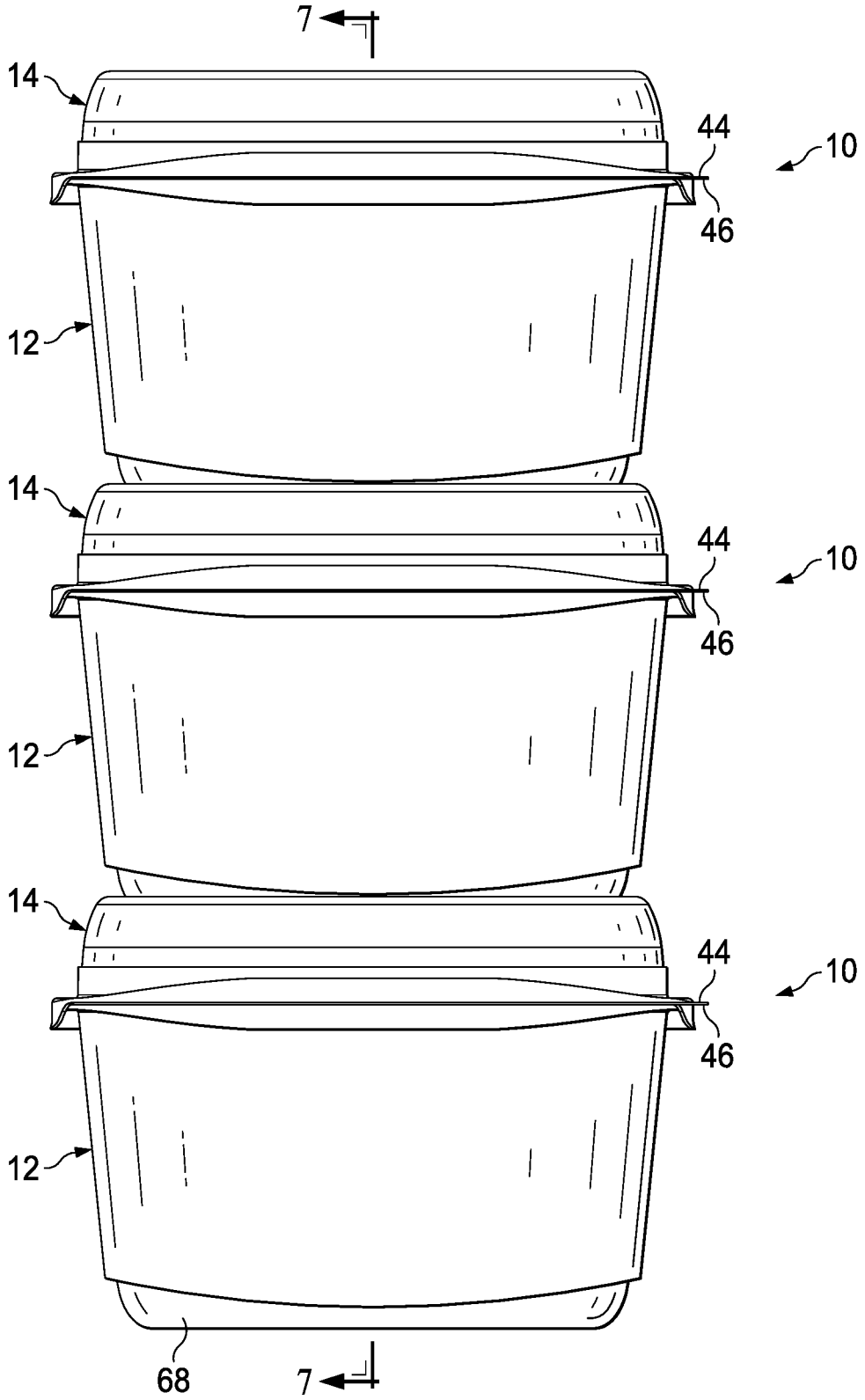
FIGS. 6 and 7 are side, elevation and cross section views respectively of a stacked configuration of the food containment assembly.
Figure 7:
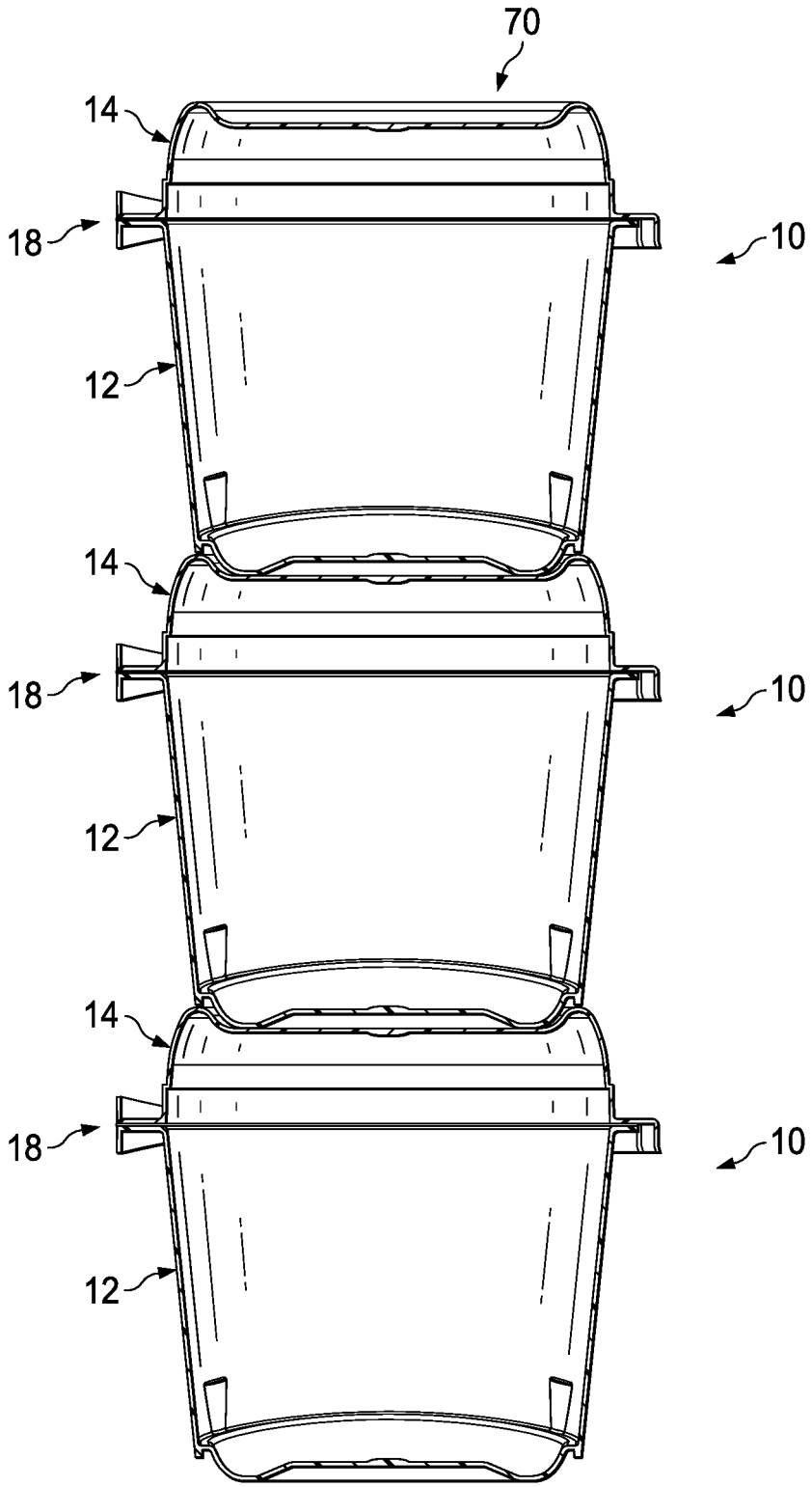

Reference is made to FIG. 6, which is a side, elevation view of stacked food containment assemblies 10. FIG. 7 is a cross section of FIG. 6. The outer surface of the bottom wall 28 facilitates stacking of the assemblies in the form of a stacking projection 68. The stacking projection 68 of the primary cup 12 may be received by a stacking recess 70 in the secondary cup 14, as shown in FIGS. 6 and 7.

FIG. 8 is a top plan view of an alternate embodiment of a food containment assembly 80. FIG. 9 is a side elevation of the food containment assembly 90, and FIG. 10 is a different side, elevation view of the food containment assembly 90. The food containment assembly 90 may include all of the features described above, with the exception that the secondary cup is replaced by a second primary cup 12. The seal sheet hinge 18 and the hinge tear notch in the seal sheet 16 and their respective functionality are as disclosed above.

FIGS. 11A-11G are various views of an alternate embodiment of a food containment assembly 110. The assembly 110 is formed of separate food containers or cups joined by a seal sheet hinge 118. According to one embodiment, the seal sheet forming the hinge may be a foil material, and thus may be referred to as foil and the hinge may be referred to as a foil hinge. A primary cup 112 is disposed adjacent a secondary cup 114 and a seal sheet is adhered to sealing flange portions of the cups 112, 114. The secondary cup 114 is similar to the secondary cup 14 of FIGS. 1A-1I except that the secondary cup 114 does not include a skirt extending above the sealing flange. In this embodiment, a liquid adhesive may be used to secure the secondary cup 114 to the primary cup 112 in the face-to-face orientation shown in FIG. 11G, as described in more detail above.

Embodiments of the invention have been described and illustrated above. The invention is not limited to the disclosed embodiments. For example, the present disclosure contemplates an embodiment where the seal sheet 16 is adhered to the sealing flange 32 of the primary cup 12 (or the secondary cup 14) and adhered to only the portion of the secondary sealing flange 40 disposed adjacent the primary sealing flange 32 of the primary cup 12 (or the secondary cup 14) to create the seal sheet hinge 18. An example of this embodiment is shown in FIG. 4. The cup that is not sealed with the seal sheet may contain dry ingredients, either loosely contained with the unsealed cup or in a separate package. Rotating one of the cups 180 degrees and snapping the cups together, as described above, contains the dry ingredients, such as granola or crackers, in the hinge-joined separate cup assembly.

Numerous other changes, substitutions, variations, alterations, and modifications may be ascertained by those skilled in the art and it is intended that the present invention encompass all such changes, substitutions, variations, alterations, and modifications as falling within the spirit and scope of the appended claims.

What is claimed is:

1. A food containment assembly, comprising:

a first cup defining a first cavity and comprising a first seal flange and a first cavity seal bead encircling the first cavity, the first seal flange further comprising a first hinge seal bead disposed offset from the first cavity seal bead;

a second cup defining a second cavity and comprising a second seal flange and a second cavity seal bead encircling said second cavity, the second seal flange further comprising a second hinge seal bead disposed offset from the second cavity seal bead, the second cup being separate from and disposed adjacent to the first cup;

a seal sheet adhered to the first cavity seal bead, the first hinge seal bead, the second cavity seal bead, and the second hinge seal bead, the seal sheet extending between the first cup and the second cup joining the first cup to the second cup and forming a hinge to allow rotation of the second cup with respect to the first cup; and wherein the hinge is configured to be maintained when the seal sheet is torn between the first cavity seal bead and the first hinge seal bead to allow access to the first cavity, and also configured to be maintained when the seal sheet is torn between the second cavity seal bead and the second hinge seal bead to allow access to the second cavity.

2. The food containment assembly of claim 1 wherein the seal sheet remains adhered to the first hinge seal bead and the second hinge seal bead after being torn to allow access to the first and second cavities.

3. The food containment assembly of claim 1 wherein the seal sheet comprises a first slit disposed between the first cavity seal bead and the first hinge seal bead, and the seal sheet further comprises a second slit formed between the second cavity seal bead and the second hinge seal bead.

4. The food containment assembly of claim 3 wherein the seal sheet includes a first tear notch disposed aligned with the first slit and a second tear notch disposed aligned with the second slit.

5. The food containment assembly of claim 1 wherein the seal sheet comprises a first perforation disposed between the first cavity seal bead and the first hinge seal bead, and the seal sheet further comprises a second perforation formed between the second cavity seal bead and the second hinge seal bead.

6. The food containment assembly of claim 5 wherein the seal sheet includes a first tear notch disposed aligned with the first perforation and a second tear notch disposed aligned with the second perforation.

7. The food containment assembly of claim 1 wherein the seal sheet comprises a hinge tear notch disposed proximate a junction of the first cup and the second cup.

8. The food containment assembly of claim 7 wherein at least a portion of at least one of the first hinge seal bead and the second hinge seal bead extends beyond the hinge tear notch.

9. The food containment assembly of claim 1 wherein the hinge allows rotation of the second cup with respect to the first cup in a first direction, and wherein the first seal flange contacts the second seal flange and thereby prevents further rotation of the second cup with respect to the first cup in a second direction.

10. The food containment assembly of claim 1 further comprising a first overhang wall extending from the first seal flange and a second overhang wall extending from the second seal flange, and wherein the hinge allows rotation of the second cup with respect to the first cup in a first direction, and wherein the first overhang wall contacts the second overhang wall and thereby prevents rotation of the second cup with respect to the first cup in a second direction opposite the first direction.

11. The food containment assembly of claim 10 wherein the contact of the first overhang wall with the second overhang wall maintains the second cup generally parallel with the first cup.

12. A food containment assembly, comprising:

a first cup defining a first cavity and comprising a first seal flange;

a second cup defining a second cavity and comprising a second seal flange, the second cup being separate from and disposed adjacent to the first cup;

a seal sheet adhered to the first seal flange and the second seal flange, the seal sheet securing the first cup and the second cup together and forming a hinge with a length to allow rotation of the second cup with respect to the first cup; and wherein the seal sheet is configured such that when the seal sheet is removed from the first seal flange to allow access to the first cavity the length of the hinge is maintained intact and when the seal sheet is removed from the second seal flange to allow access to the second cavity the length of the hinge is maintained intact.

13. The food containment assembly of claim 12 wherein the seal sheet comprises a foil material.

14. The food containment assembly of claim 12 wherein the seal sheet comprises a first slit disposed above the first seal flange and a second slit disposed above the second seal flange.

15. A method for filling a food containment assembly, comprising:

providing a first cup defining a first cavity and comprising a first seal flange and a first cavity seal bead encircling the first cavity, the first seal flange further comprising a first hinge seal bead disposed offset from the first cavity seal bead;

providing a second cup defining a second cavity and comprising a second seal flange and a second cavity seal bead encircling said second cavity, the second seal flange further comprising a second hinge seal bead disposed offset from the second cavity seal bead, the second cup being separate from the first cup;

positioning the second cup adjacent the first cup;

adhering a seal sheet to the first cavity seal bead, the first hinge seal bead, the second cavity seal bead, and the second hinge seal bead, the seal sheet joining the first cup to the second cup and forming a hinge to allow rotation of the second cup with respect to the first cup; and rotating the second cup with respect to the first cup about the hinge, wherein the hinge is maintained when the seal sheet is torn between the first cavity seal bead and the first hinge seal bead to allow access to the first cavity, and also maintained when the seal sheet is torn between the second cavity seal bead and the second hinge seal bead to allow access to the second cavity.

16. The method of claim 15 wherein adhering the seal sheet to the first cavity seal bead comprises applying heat to activate an adhesive.

17. The method of claim 15 further comprising folding a first pull tab portion of the seal sheet extending from the first cup to be disposed within a first perimeter of the first cup.

18. The method of claim 17 further comprising folding a second pull tab portion of the seal sheet extending from the second cup to be disposed within a first perimeter of the second cup.

19. The food containment assembly of claim 12 wherein the seal sheet is configured such that when the seal sheet is removed from the entirety of the first seal flange to allow access to the first cavity the length of the hinge is maintained intact.

* * * * *